US007172167B2

(12) United States Patent
Phifer et al.

(10) Patent No.: US 7,172,167 B2
(45) Date of Patent: Feb. 6, 2007

(54) READING STAND

(75) Inventors: Beverly C. Phifer, Tuscaloosa, AL (US); M. Scott Clark, Tuscaloosa, AL (US); Thomas G. Grammer, Northport, AL (US)

(73) Assignee: Phifer Incorporated, Tuscaloosa, AL (US)

( * ) Notice: Subject to any disclaimer, the term of this patent is extended or adjusted under 35 U.S.C. 154(b) by 0 days.

(21) Appl. No.: 10/787,150

(22) Filed: Feb. 27, 2004

(65) Prior Publication Data

US 2004/0256534 A1 Dec. 23, 2004

Related U.S. Application Data

(60) Provisional application No. 60/449,864, filed on Feb. 27, 2003.

(51) Int. Cl.
*A47B 97/04* (2006.01)

(52) U.S. Cl. ..... 248/460; 248/461; 248/462; 248/455; 108/6; 108/11; 190/30; 190/901; 150/143; 206/45.2; 312/245

(58) Field of Classification Search ..... 248/460, 248/461, 462, 463, 465, 454, 455, 451, 452, 248/453, 441.1, 447, 445, 456, 444, 447.1, 248/457, 371; 108/6, 9, 11, 14; 220/379, 220/744; 206/45.2, 45.23, 424; 190/30, 190/901; 150/143; 281/33, 45; 402/4, 73, 402/76; D19/88; 312/245
See application file for complete search history.

(56) References Cited

U.S. PATENT DOCUMENTS 43,575 A 7/1864 Dimon et al.
352,654 A * 11/1886 Morton ..... 248/452
542,809 A 7/1895 Reid
582,140 A * 5/1897 Nolon ..... 248/452
590,175 A * 9/1897 Trussell ..... 24/67.7
793,978 A * 7/1905 Beidler ..... 248/446
993,761 A * 5/1911 Crane ..... 248/453
1,111,607 A * 9/1914 Nyberg ..... 248/451
1,203,659 A * 11/1916 Smith ..... 248/456
1,821,060 A * 9/1931 Isaacson ..... 248/455

(Continued)

OTHER PUBLICATIONS

"You can do it Bindependent We Can Help, Adapt-A-Lab book holder," Adapt-A-Lap book holder, 4 pages from www.bindependent.com.

(Continued)

*Primary Examiner*—Kimberly Wood
(74) *Attorney, Agent, or Firm*—Hunton & Williams

(57) ABSTRACT

The invention provides a reading stand. The reading stand may include a base including a base member case. Further, the reading stand may include a reading lid disposed upon the base member case, the reading lid including a reading platform having a front side and a backside; and at least one page holder adjustably mounted on the reading platform so as to assist in retaining a document on the front side of the reading platform. Further, a support member is provided. The support member extends from the backside of the reading platform, and is adapted to engage with the base so as to support the reading lid upon the base. For example, the support member may be in the form of a side support clip that substantially vertically supports the reading lid upon the base for side reading.

36 Claims, 20 Drawing Sheets

U.S. PATENT DOCUMENTS

| | | | | | |
|---|---|---|---|---|---|
| 1,919,835 | A | * | 7/1933 | Fritz | 248/445 |
| 2,003,746 | A | * | 6/1935 | Headington | 248/452 |
| 2,489,553 | A | * | 11/1949 | Wofford | 190/1 |
| 2,627,694 | A | * | 2/1953 | Saecker | 248/447 |
| 3,952,989 | A | | 4/1976 | Bannister Hatcher | |
| 4,014,508 | A | | 3/1977 | Weiss | |
| 4,015,813 | A | | 4/1977 | Graham | |
| 4,043,530 | A | * | 8/1977 | May | 248/453 |
| 4,163,539 | A | * | 8/1979 | Awofolu | 248/452 |
| D269,188 | S | | 5/1983 | Tisdale | |
| 4,436,271 | A | | 3/1984 | Manso | |
| 4,896,252 | A | | 1/1990 | Stewart | |
| 5,375,806 | A | | 12/1994 | Debus et al. | |
| D373,600 | S | | 9/1996 | Oimas | |
| 5,651,525 | A | * | 7/1997 | Yang | 248/456 |
| 5,797,578 | A | * | 8/1998 | Graffeo et al. | 248/453 |
| 5,855,329 | A | * | 1/1999 | Pagano | 248/451 |
| 5,855,351 | A | * | 1/1999 | Cziraky et al. | 248/451 |
| 6,038,983 | A | * | 3/2000 | Lendl | 108/44 |
| 6,085,917 | A | | 7/2000 | Odom | |
| 6,109,658 | A | | 8/2000 | Moore | |
| 2002/0044819 | A1 | * | 4/2002 | Shamoon | 402/73 |
| 2003/0029985 | A1 | * | 2/2003 | Zeller et al. | 248/461 |

OTHER PUBLICATIONS

"Bodygaurd, Nellie's Exercise Equipment . . .," 1 page from nellies.com.

"Large And Small Paperbacks Stay . . .,"1 page from store3.yimg.com.

"Relieve Neck and Back Pain, Improve Your Reading Immeciately with Our Adjustable Book Holders," 4 pages from www.proportionalreading.com.

"Atlas™ Ergonomic Book & Copy Holders," 1 page from www.bookandcopyholders.com.

"Book Holders," 1 page from sfpl.lib.ca.us.

"You can do it Bindependent We Can Help. Two-Piece Tilting Table." 2 pages from www.bindependent.com.

European Search Report mailed Mar. 23, 2006, PCT/US2004005705.

* cited by examiner

On-side bed reading position

READING STAND

This application claims priority to U.S. Provisional Application No. 60/449,864 filed Feb. 27, 2003, and entitled "Book Holder," which is incorporated herein by reference in its entirety.

BACKGROUND OF THE INVENTION

The invention relates to devices to support a book or other reading material item or items.

Various devices have been used in the past to support a book, or other reading material item, such that the book may be easily supported and in a position to easily view the contents of the book. However, known devices for supporting a reading material item have various deficiencies. Some known devices are difficult to hold for extended periods of time, as is often desired when reading. Further, while other devices may be easy to hold in general, they do not support the reading material in such a manner so that it is easy to turn the pages of the reading material. Other problems exist with known devices.

BRIEF SUMMARY OF THE INVENTION

In accordance with one embodiment, the invention provides a reading stand comprising a base including a base member case, the base member case including a base panel and walls connected to the base panel to form an enclosed volume; and a reading lid disposed upon the base member case. The reading lid may include a reading platform having a front side and a backside; at least one page holder adjustably mounted on the reading platform so as to assist in retaining a document on the front side of the reading platform; and a support member, the support member extending from the backside of the reading platform, the support member adapted to engage with the base so as to support the reading lid upon the base.

In accordance with a further embodiment, the invention provides a reading stand, for holding a document for reading, comprising a base; a reading lid including a reading platform, a hinge and a side support clip, the reading lid further including at least one page holder; the hinge adapted to connect the base to the lid such that the lid is disposed in a closed position over the base; and the side support clip adapted to connect the base to the lid such that the lid is disposed in a substantially vertical position over the base so as to afford side reading.

In accordance with a further embodiment, the invention provides a method for supporting a document using a reading stand, the reading stand having a lid and a base, the method comprising placing an opened book on the lid of the reading stand and under at least one page holder, which is connected to the lid; pulling out a center document support from under the lid and rotating the center document support upward; pushing the center document support through a slot and onto the book; unsnapping the lid from the base; and positioning the lid so as to attach the reading lid substantially vertically onto a side of the base using side support clips mounted on the lid, so as to attach the lid to the base and provide side reading.

In accordance with a further embodiment, the invention provides a reading stand having a lid and a base, the reading stand comprising: means for placing an opened book on the lid of the reading stand and under at least one page holder, which is connected to the lid; means for pulling out a center document support from under the lid and rotating the center document support upward, and thereafter pushing the center document support through a slot and onto the book; means for unsnapping the lid from the base; and means for positioning the lid so as to attach the reading lid substantially vertically onto a side of the base using side support clips mounted on the lid, so as to attach the lid to the base and provide side reading.

In accordance with a further embodiment, the invention provides a reading stand comprising: a reading platform; and at least one page holder pivotally disposed upon and connected to the reading platform, the page holder biased against the reading platform for retaining a document. The page holder includes a holder housing portion extending along a first side of the page holder; a center planar portion extending along the holder housing portion; and an arcuate flange extending along the center planar portion, an aperture being defined by the arcuate flange and the center planar portion.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF THE INVENTION

Hereinafter, aspects of the invention in accordance with various embodiments will be described. As used herein, any term in the singular may be interpreted to be in the plural, and alternatively, any term in the plural may be interpreted to be in the singular.

The inventive device is used to hold books, or other reading items, open so that the book may be read without holding it in the reader's hands, in accordance with one aspect of the invention. In accordance with one embodiment of the invention as described below, an arrangement is provided with a support surface, along with clamps or arms, that hold the opposite pages of a book, for example, open in a fashion so that the book can be read without physically holding the pages of the book. For example, the reading stand may be used while exercising. In accordance with another use of the invention, the reading stand of the invention may be stood on either end so that a person may read while lying in bed or on his side or her side.

FIGS. 1–6 are various perspective views showing a reading stand 10 in accordance with one embodiment of the invention. As shown, the reading stand 10 includes a base 100 and a reading lid 200. Together, the base 100 and the reading lid 200 provide a versatile document support.

Figure 2:
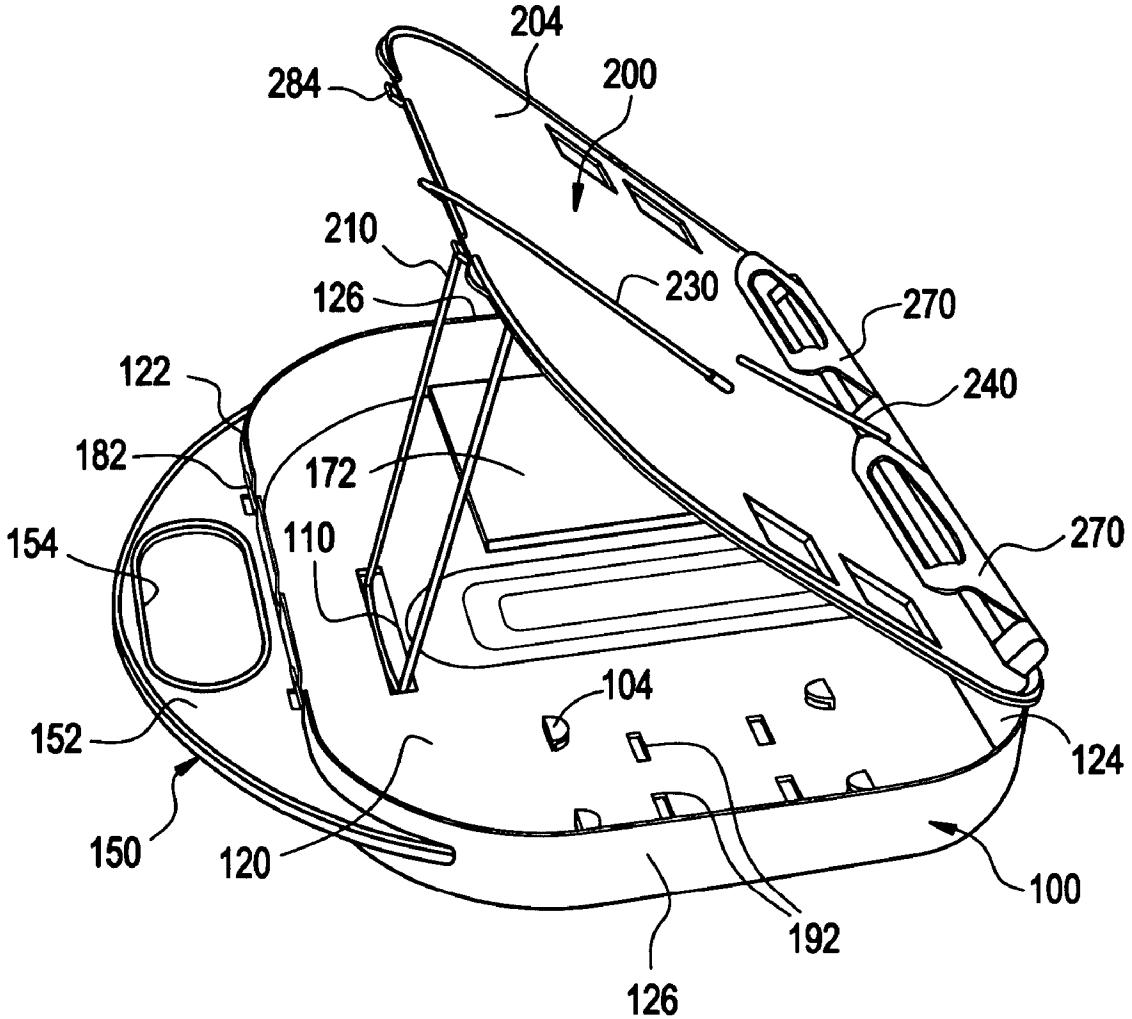
FIG. 2 is a back perspective view of the reading stand of FIG. 1 for supporting a book in accordance with one embodiment of the invention.

The base 100 includes a base member case 101 that forms a case that may be used to hold papers, writing instruments, recipes or other items, as may be desired. In particular, the base member case 101 includes a base panel, along with a base front wall 122, a base back wall 124 and two base side walls 126, as shown in FIG. 2. The walls are connected to the base panel to form an enclosed volume, i.e., with the reading lid 200 positionable to be a lid for the enclosed volume.

Figure 1:
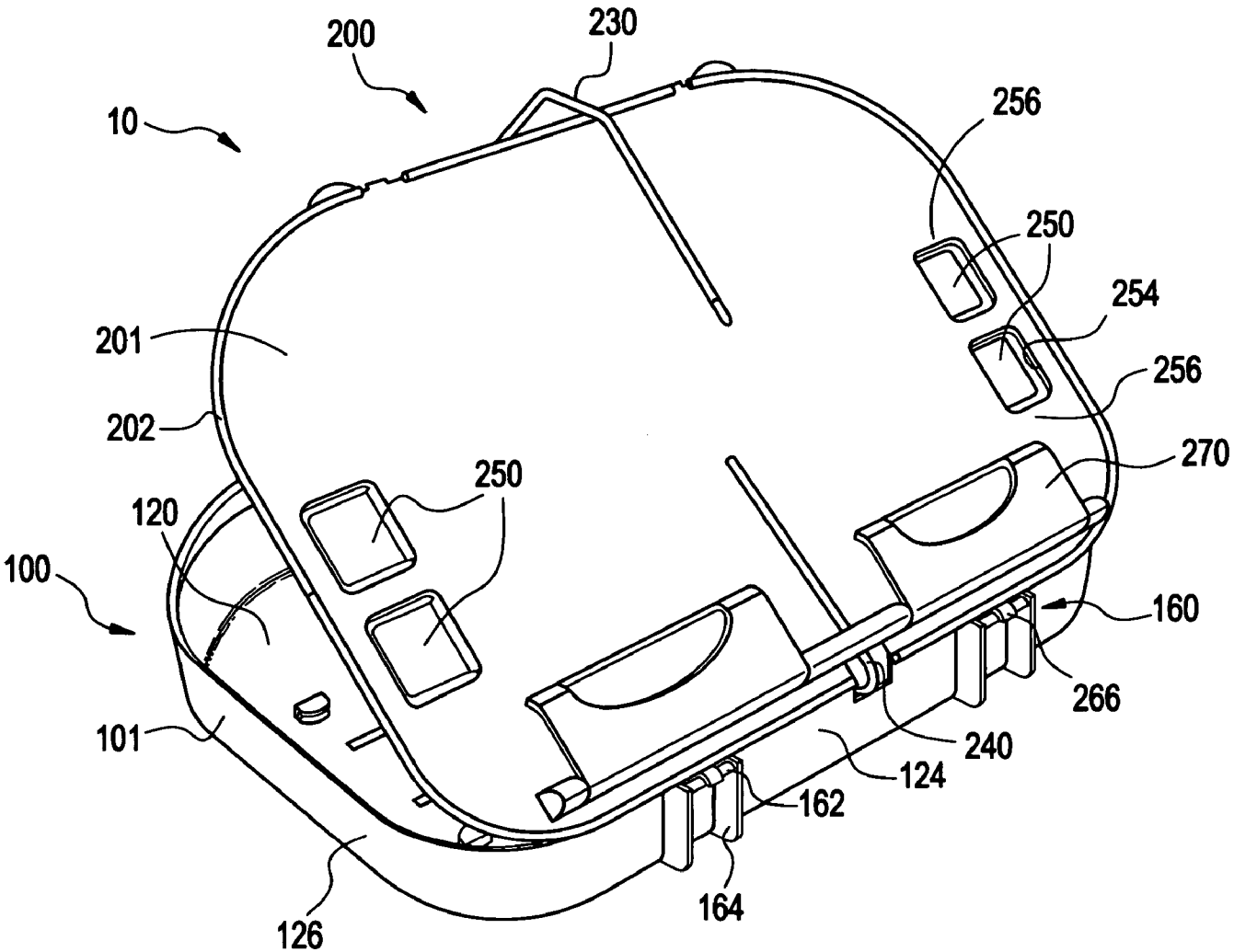
FIG. 1 is a front perspective view of a reading stand for supporting a book in accordance with one embodiment of the invention.

In accordance with one embodiment of the invention, the reading lid 200 may include a reading platform 201 having a reading platform backside 203 and a reading platform front side 204. Further, as shown in FIG. 1, the reading lid 200 includes two page holders 270. The page holders 270 may be spring biased, for example, so as to assist in retaining a document upon the reading lid front side 204.

Figure 3:
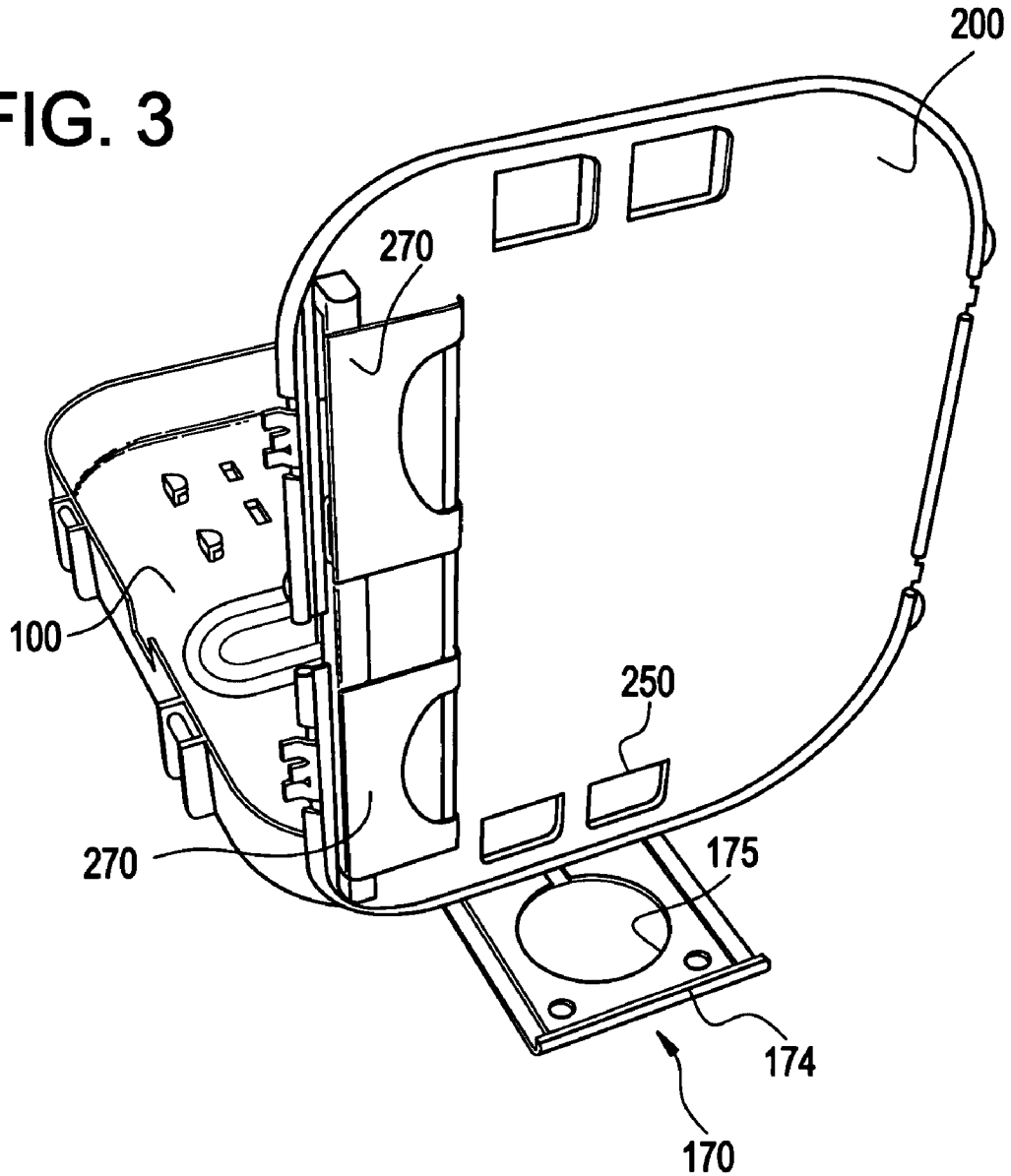
FIG. 3 is a front perspective view of a reading stand of FIG. 1 for supporting a book, in an alternative arrangement for side reading, in accordance with one embodiment of the invention.

Further, the reading lid 200 includes a support member. The support member extends from the reading platform backside 203. The support member is adapted to engage with the base member case 101 so as to support the reading lid. To explain, the support member may be in the form of two structures. For example, the support member may be in the form of a prop member 210. Further, in accordance with one embodiment of the invention, a support member may also be provided in the form of a side support clip 250. The prop member 210 may be utilized to support the reading platform 201 so as to afford reading a document in a substantially vertical orientation. Alternatively, the side support clip 250 or clips afford reading a document in a side position, as shown in FIG. 3. As shown in FIG. 1, in accordance with one embodiment of the invention, the reading stand 10 is provided with both the prop member 210 and the side support clips 250.

Figure 4:
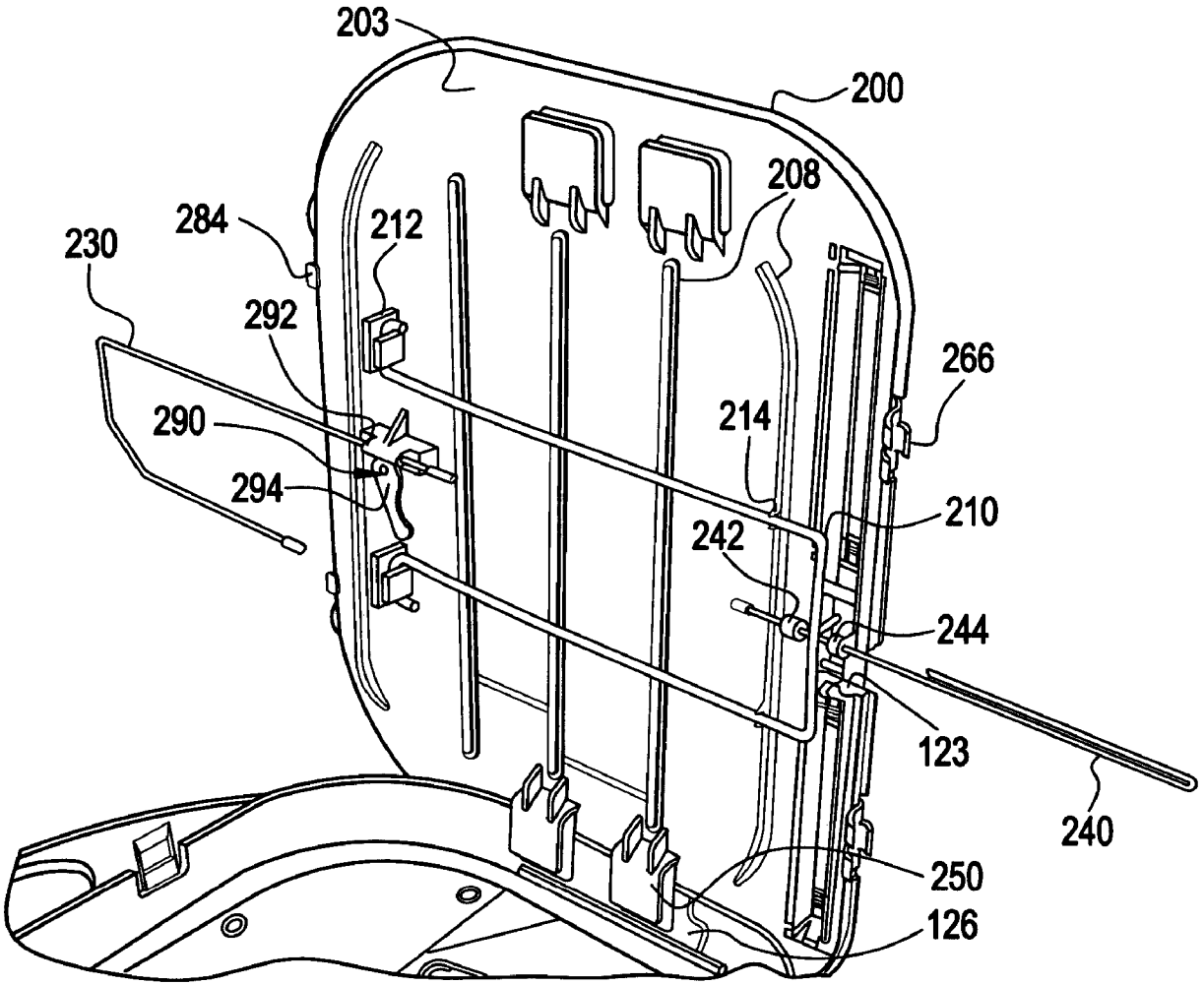
FIG. 4 is a back perspective view of the reading stand of FIG. 3, in an alternative arrangement for side reading, in accordance with one embodiment of the invention.

In further explanation of the prop member 210, FIGS. 2 and 4 show further views of the reading stand 10 of FIG. 1. As shown in FIG. 4 in particular, the prop member 210 may be pivotally connected to the backside 203 of the reading platform by a pair of support member hinges 212. The prop member 210 is engageable with the base member case 101 so as to support the reading platform in a variety of positions. For example, the prop member 210 may be in the form of a wire shaped into a u-shape. However, it should be appreciated that other arrangements, e.g., such as a plastic structure, might be used in lieu of the wire arrangement.

In accordance with one embodiment of the invention, the base panel 120 may be provided with a prop slot 110. The prop member 210 is extendable through the prop slot 110 to extend exterior to the base member case so as to provide a hanger for the reading stand. For example, the prop member 210 may extend through the prop slot 110 to provide a hanger for securing the reading stand on a treadmill structure, in accordance with one favored use of invention. As should be appreciated, in this arrangement with the prop member extending through the prop slot to extend exterior to the base member case, the reading lid is typically disposed upon the base member case in a closed position, i.e., the reading platform 201 rests upon the walls (122, 124, 126) of the base member case 101.

However, in an alternative arrangement, the prop member 210 does not pass through the prop slot 110 (so as to provide a hanger for the reading stand 10), but rather, the prop member 210 is positioned so as to rest upon the lower panel of the base member case 101, i.e., so as to rest upon the base panel 120, as shown in FIGS. 1 and 2. The prop member may be positioned to support the reading platform at a variety of angles relative to the base panel. For example, the reading platform may be disposed between approximately 20 degrees and 70 degrees relative to the base panel. Such angle depends on the particular location that the prop member 210 rests on the base panel 120. Relatedly, the base panel 120 might be provided with raised ribs, for example, so as to prevent the prop member 210 from sliding from a desired position. Also, the prop member 210 might be disposed on the prop slot 110 as shown in FIG. 2, i.e., so as to rest upon the same surface that the base member case 101 rests upon.

Hereinafter, further aspects of the reading lid 200 will be described. The reading lid 200 may include a page assist support 230, as shown in FIGS. 1, 2 and 4, for example. In accordance with one embodiment of the invention, the page assist support 230 may be in the form of a u-shaped wire. The page assist support 230, as shown in FIG. 4, is attached to the reading platform backside 203 using a page assist lock 290. The page assist lock 290 comprises a cam collar 292 and a cam lever 294, in accordance with one embodiment of the invention. However, other locking mechanisms might be utilized instead. While not in use, the page assist support 230 may be stowed behind the reading platform 201. Then, when a reader desires to use the page assist support 230, the user manipulates the page assist support 230 so that a portion of the page assist support 230 is positioned in front of the reading platform 201, as shown in FIG. 1, for example.

Once the page assist support 230 is positioned in a desired position, the cam lever 294 may be rotated so as to frictionally bind the page assist support 230 within the cam collar 292, i.e., so as to hold the page assist support 230 in the desired position. That is, the cam lever 294 is provided with an eccentric cam surface so as to variably apply pressure on the page assist support 230 depending on the rotational position of the cam lever 294.

Figure 7:
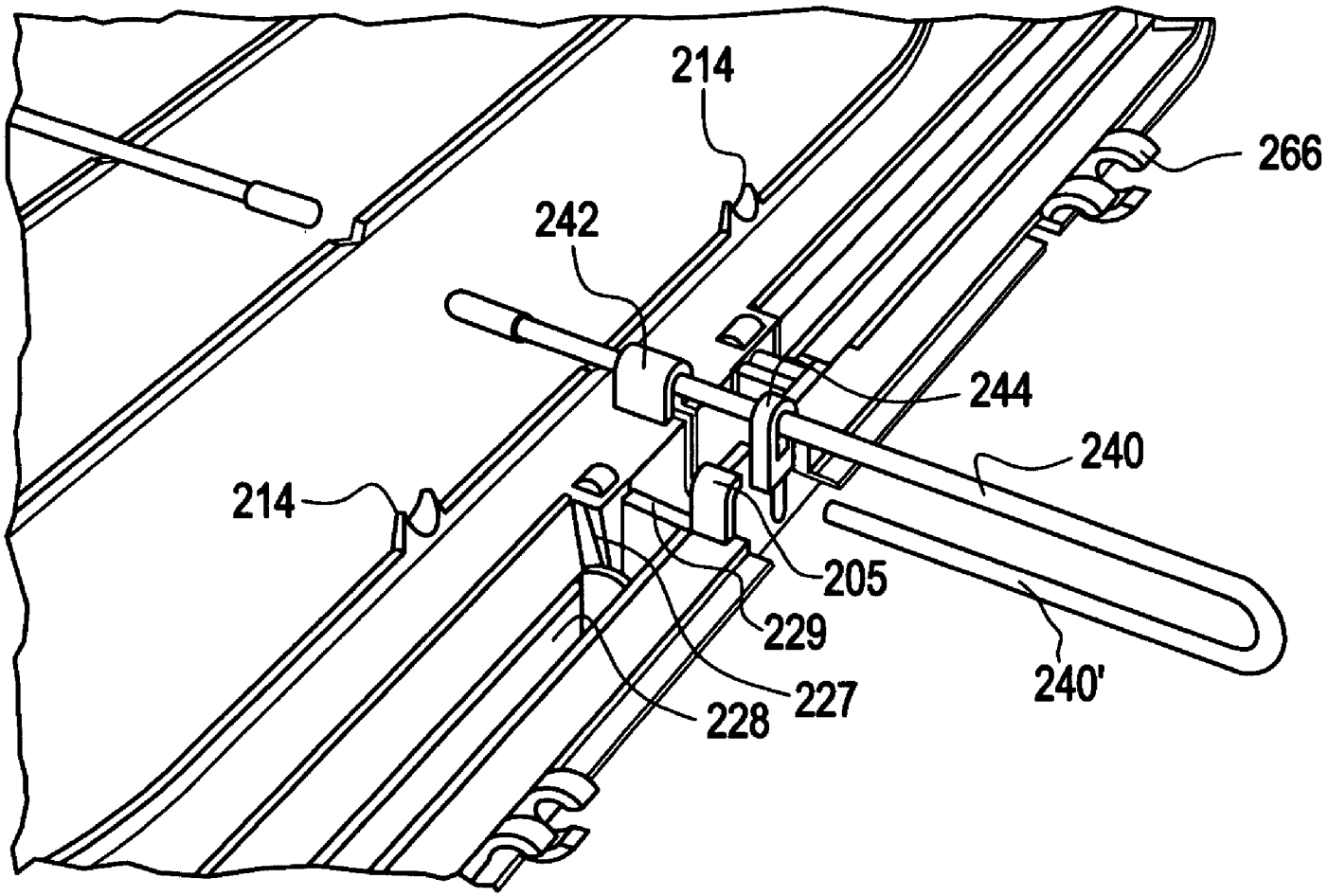
FIG. 7 is a perspective view showing further details of the reading lid underside of the reading stand of FIG. 1 in accordance with one embodiment of the invention.
Figure 11:
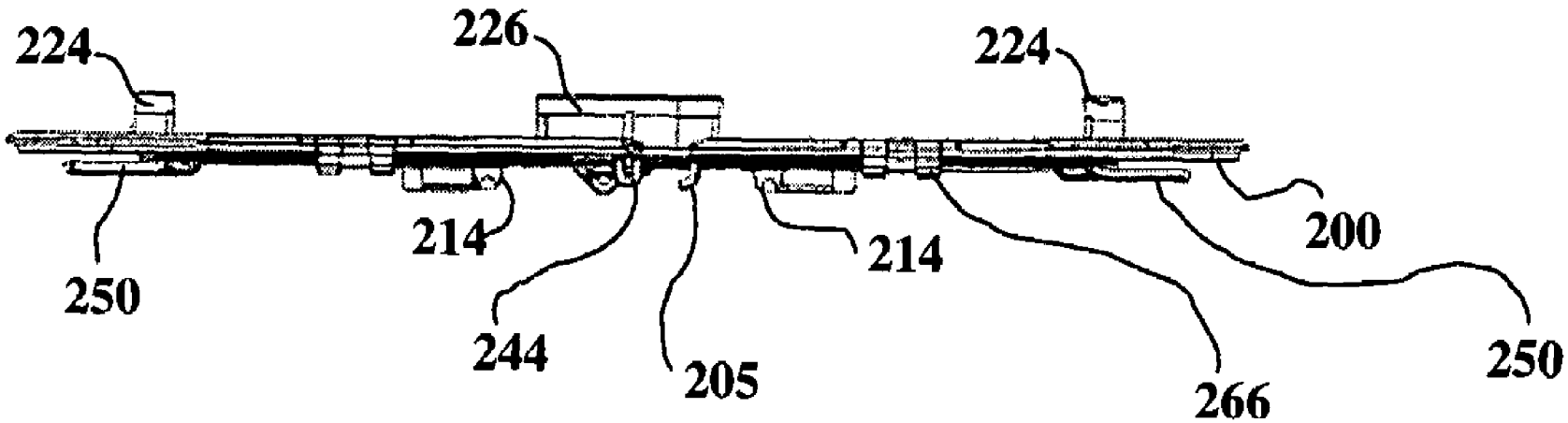
FIG. 11 is a side view of the reading lid of FIG. 9 in accordance with one embodiment of the invention.

The reading lid 200 may further be provided with a center document support 240 in accordance with one embodiment of the invention. The center document support 240 may also be in the shape of a u-shaped wire, as shown in FIGS. 1, 2 and 4, as well as FIG. 7. As shown, the center document support 240 is attached to the reading platform backside 203 using a primary collar 242 and a bracing collar 244. That is, the center document support 240 is slidably positioned within respective apertures in the primary collar 242 and a bracing collar 244. As shown in FIGS. 7 and 11, the reading lid 200 may also include a center document support retainer 205. The center document support retainer 205 serves to secure the center document support 240 while the center document support 240 is not in use, i.e., when the center document support 240 is stowed behind the reading lid 200 while the reading lid 200 is in a closed position, for example.

Figure 12:
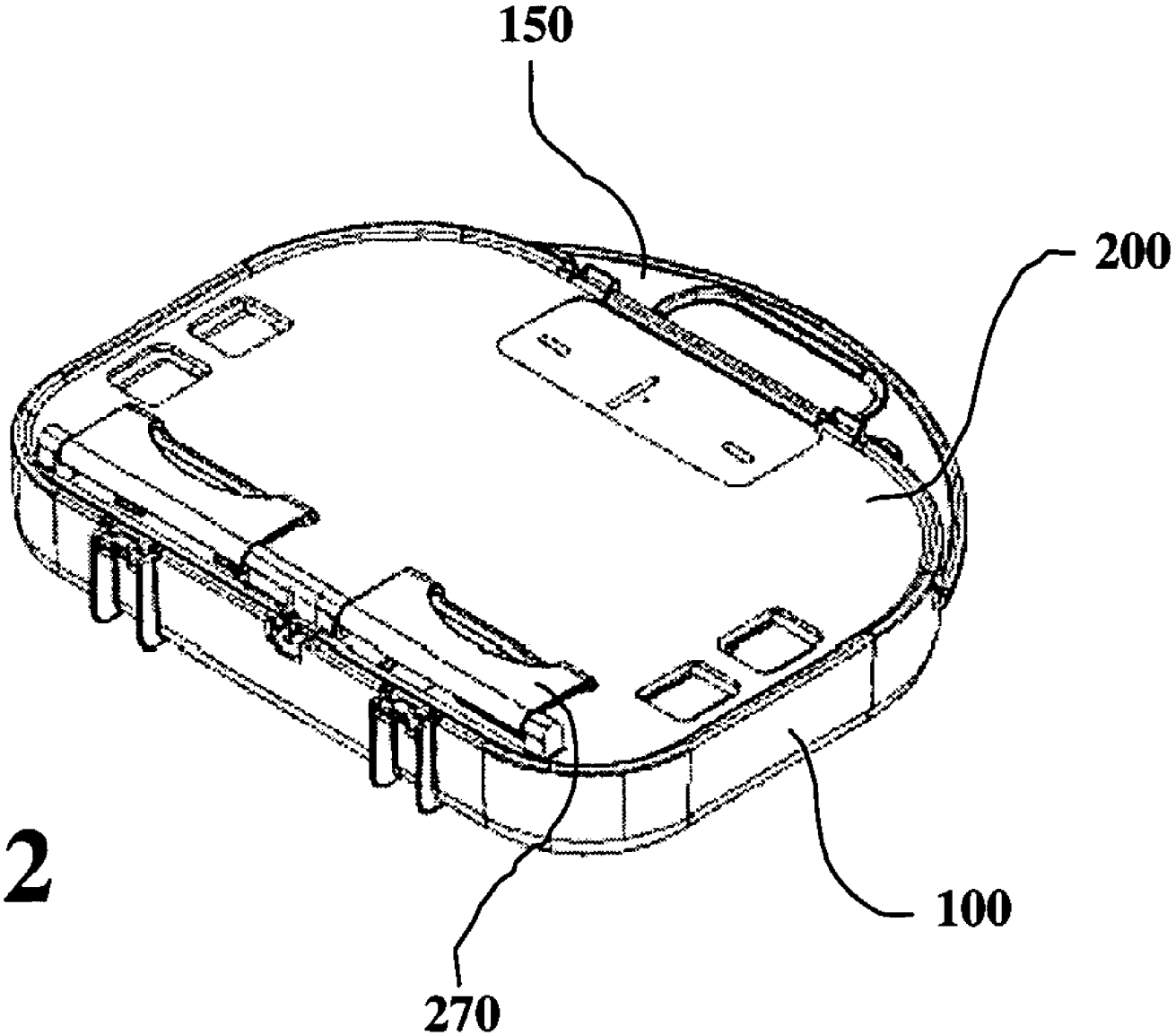
FIG. 12 is a front perspective view of a reading stand in a closed position with the base of FIG. 8 and the lid of FIG. 9 in accordance with one embodiment of the invention.

In accordance with one aspect of the invention, the reading lid 200 may further include a set of prop retainers 214 that are integrally formed with the reading platform 201, as shown in FIG. 4 and FIG. 12, for example. The prop retainers 214 serve to secure the prop member 210 when the prop member 210 is not in use.

Figure 10:
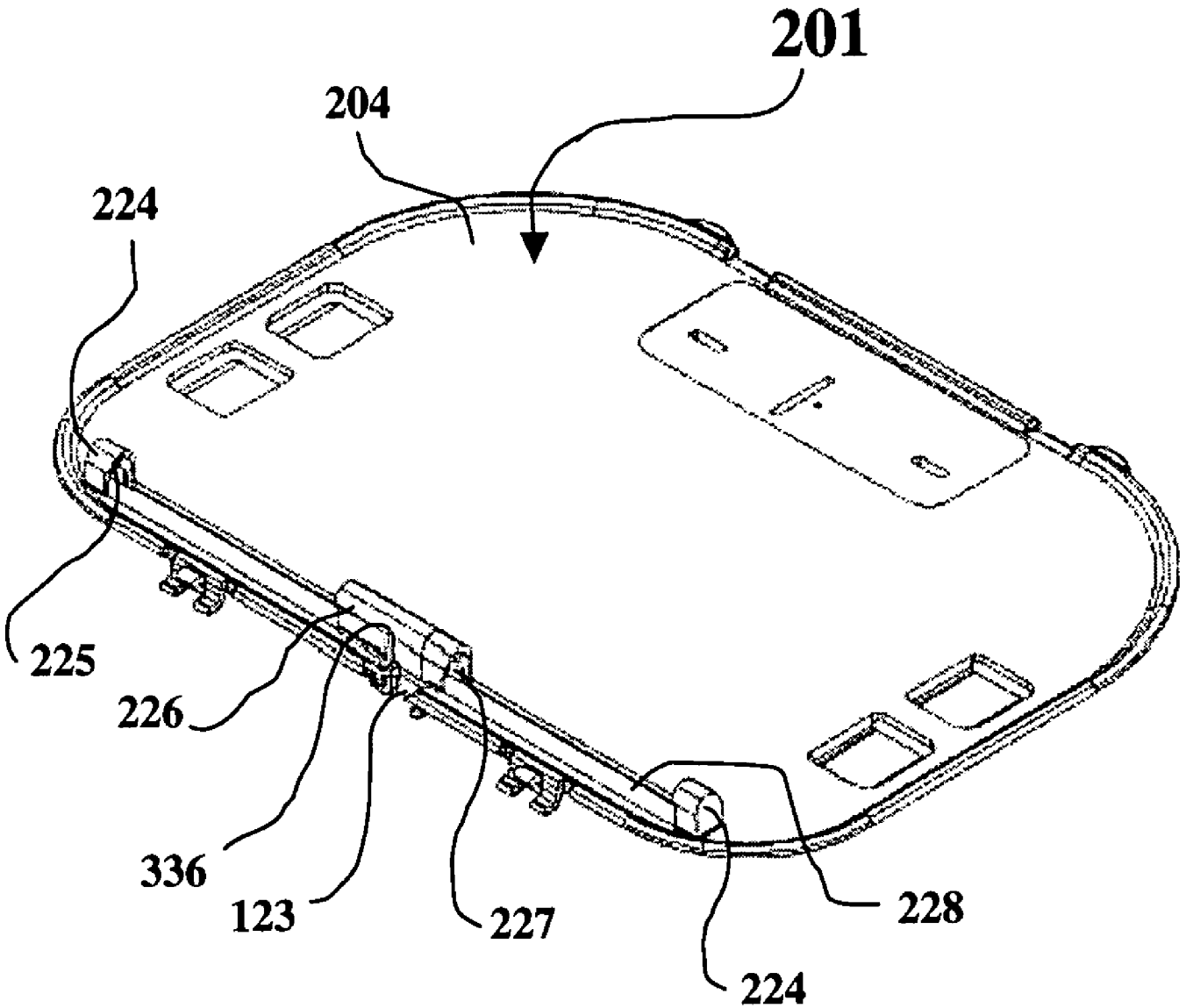
FIG. 10 is a perspective view of the reading lid of FIG. 9 in accordance with one embodiment of the invention.

As described herein, the reading lid 200 is disposed upon the base 100. In accordance with one aspect and arrangement of the invention, the reading lid 200 is supported using the prop member 210. In this arrangement, the reading lid 200 is disposed upon the base 100 using a hinge assembly 160, as shown in FIG. 1, for example. The hinge assembly 160 includes a hinge shoulder portion 266 that is integrally formed with the reading platform 201 in accordance with one embodiment of the invention. The hinge shoulder portion 266 may include a set of opposing fingers as shown in FIGS. 4 and 10, for example.

The hinge shoulder portion 266 interfaces with a pin 162 that is integrally formed with the base 100. That is, the hinge shoulder portion 266 interfaces with the pin 162 so as to provide the hinge 160, which is easily disconnectable. The pin 162 is attached to the base 100 between a flange pair 164, as shown in FIG. 1.

FIG. 3 is a front perspective view of a reading stand of FIG. 1 for supporting a book, in the alternative arrangement for side reading as discussed above, in accordance with one embodiment of the invention. As shown in FIG. 3, the reading stand 10 affords comfortable on side "hands free" reading in bed, for example. As shown, the reading lid 200 is disposed on a base side wall 126 of the base member case 101 using the side support clips 250. As should be appreciated, in such arrangement, the reading stand 10 might be prone to tipping over to the side upon which the reading lid 200 is positioned upon the base 100. In order to prevent such tipping, the reading stand 10 includes a side reading brace assembly 170.

The side reading brace assembly 170 includes a tray housing 172 and a side support tray 174. The side support tray 174 is adjustably positionable between a stowed position in which the side support tray 174 is disposed in the tray housing 172 in the base member case, and an extended position in which the side support tray 174 extends out from the base member case 101, such that the side support tray 174 prevents the reading stand 10 from tipping. The tray housing 172 in which the side support tray 174 is housed (in the stowed position) is shown from the interior in FIG. 2.

As shown in FIG. 3, the reading lid 200 may be supported by the side support clips 250 so as to be in a substantially vertical position, i.e., "substantially vertically" meaning having a sufficient vertical orientation so as to allow reading of a document disposed upon the reading lid 200.

Figure 6:
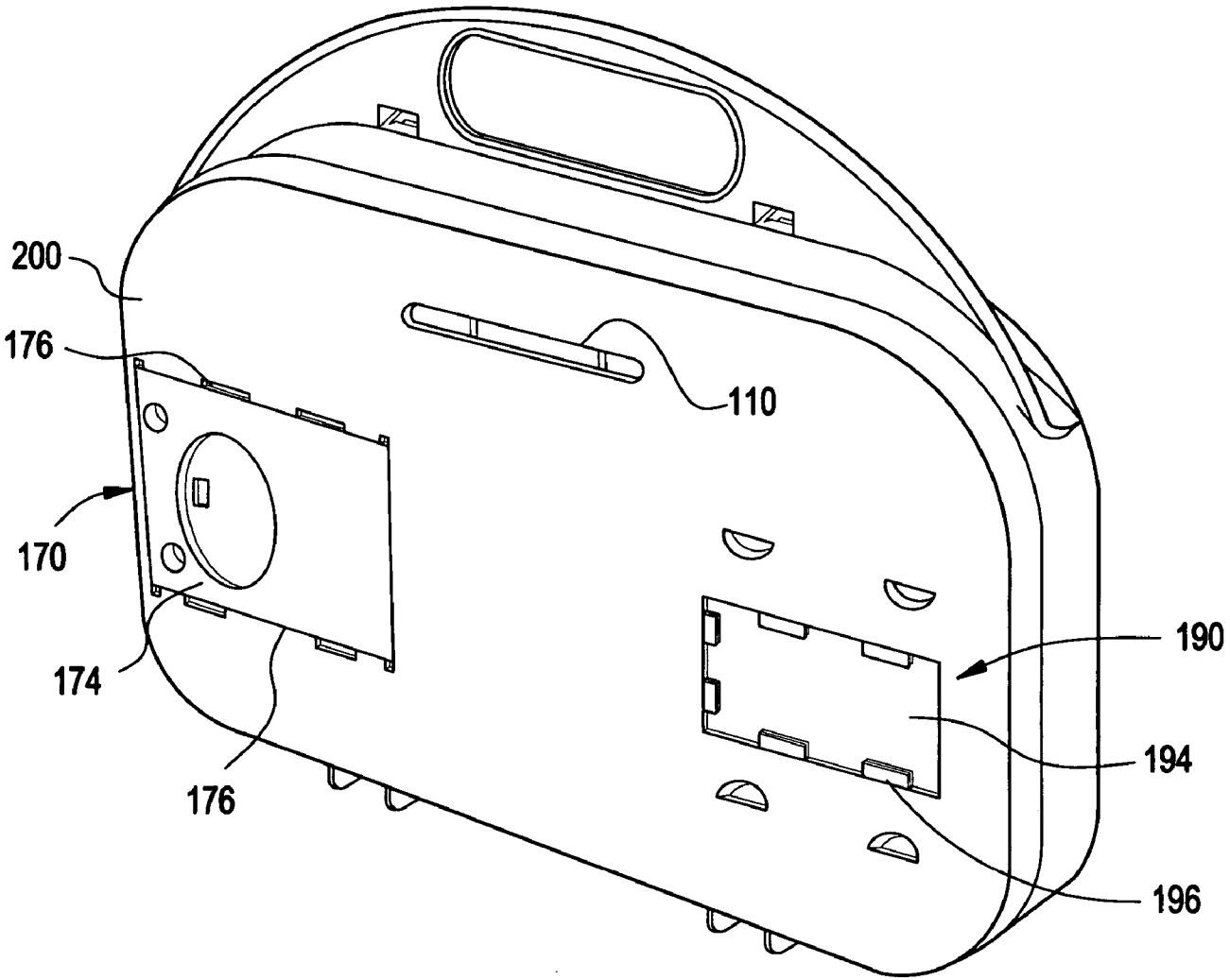
FIG. 6 is a back perspective view of the reading stand of FIG. 1 in a closed and upright position in accordance with one embodiment of the invention.
Figure 13:
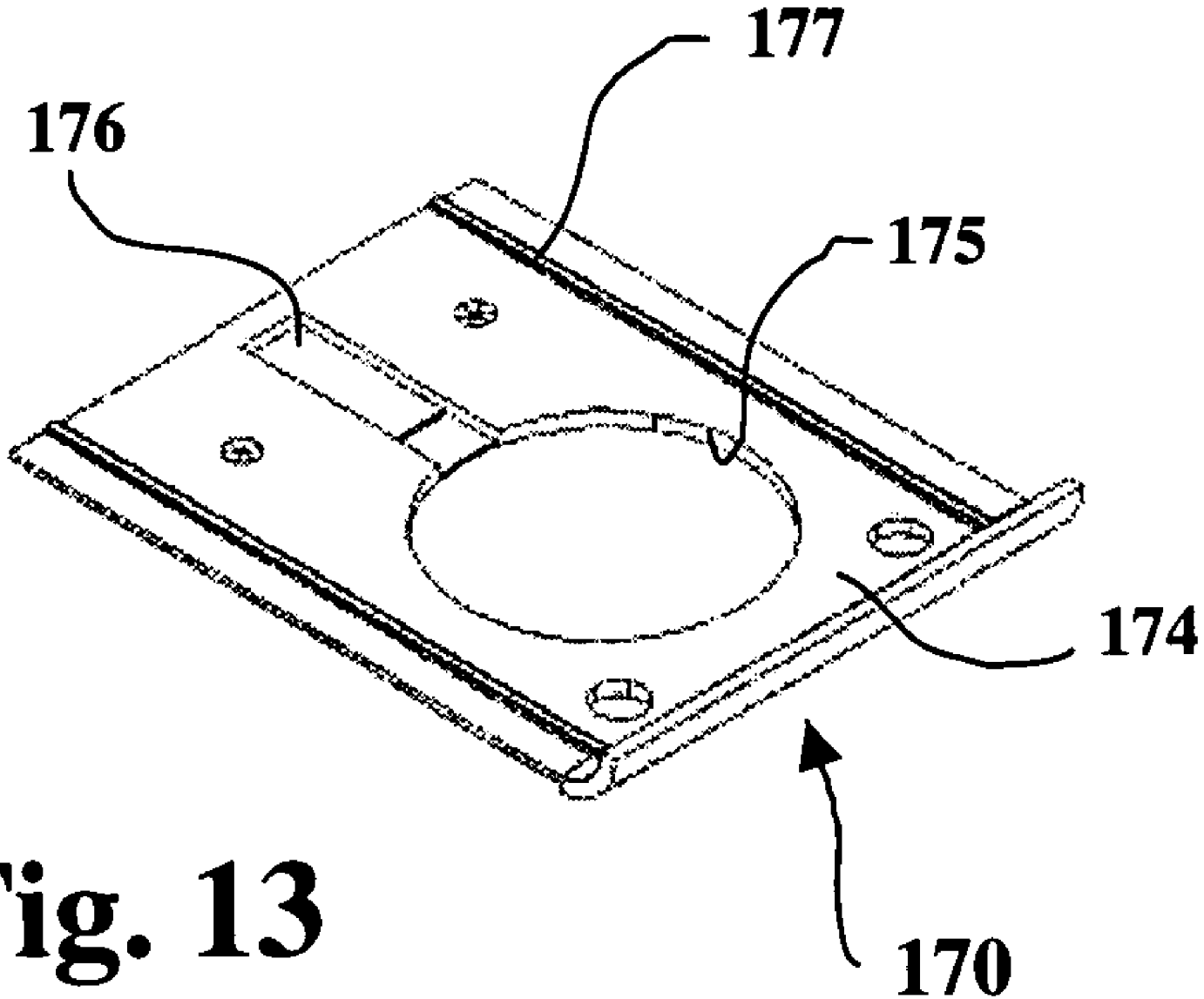
FIG. 13 is a perspective view showing further details of a side support tray in accordance with one embodiment of the invention.

FIG. 13 is provided to show the side support tray 174 in further detail. A cup aperture 175 may be disposed in the side support tray 174. Also, FIG. 6 is a back perspective view of the reading stand of FIG. 1 in a closed and upright position showing further aspects of the side reading brace assembly 170, in accordance with one embodiment of the invention. That is, as shown, the tray housing 172 may form a brace channel 176 in which the side support tray 174 is disposed in the stowed position.

FIG. 6 also shows another feature of the reading stand 10 in accordance with one embodiment of the invention. As shown, the base 100 may be provided with a cardholder 190. The cardholder 190 may comprise a recessed panel 194 in conjunction with retaining flanges 192, as also shown in FIG. 2. The cardholder 190 affords retainment of a business card, for example.

Further, the base panel 120 may be provided with four instruction booklet retainers 104, i.e., flanges 104. The instruction booklet retainers 104 serve to provide an instruction booklet holder, which may be provided to a purchaser of the reading stand 10 explaining use of the reading stand 10.

As shown in FIG. 2, the reading stand 10 may further include a handle 150. The handle 150 includes a handle flange 152 and a handle aperture 154, in accordance with one embodiment of the invention. The handle flange 152 and the handle aperture 154 afford easy carrying of the reading stand 10.

Figure 5:
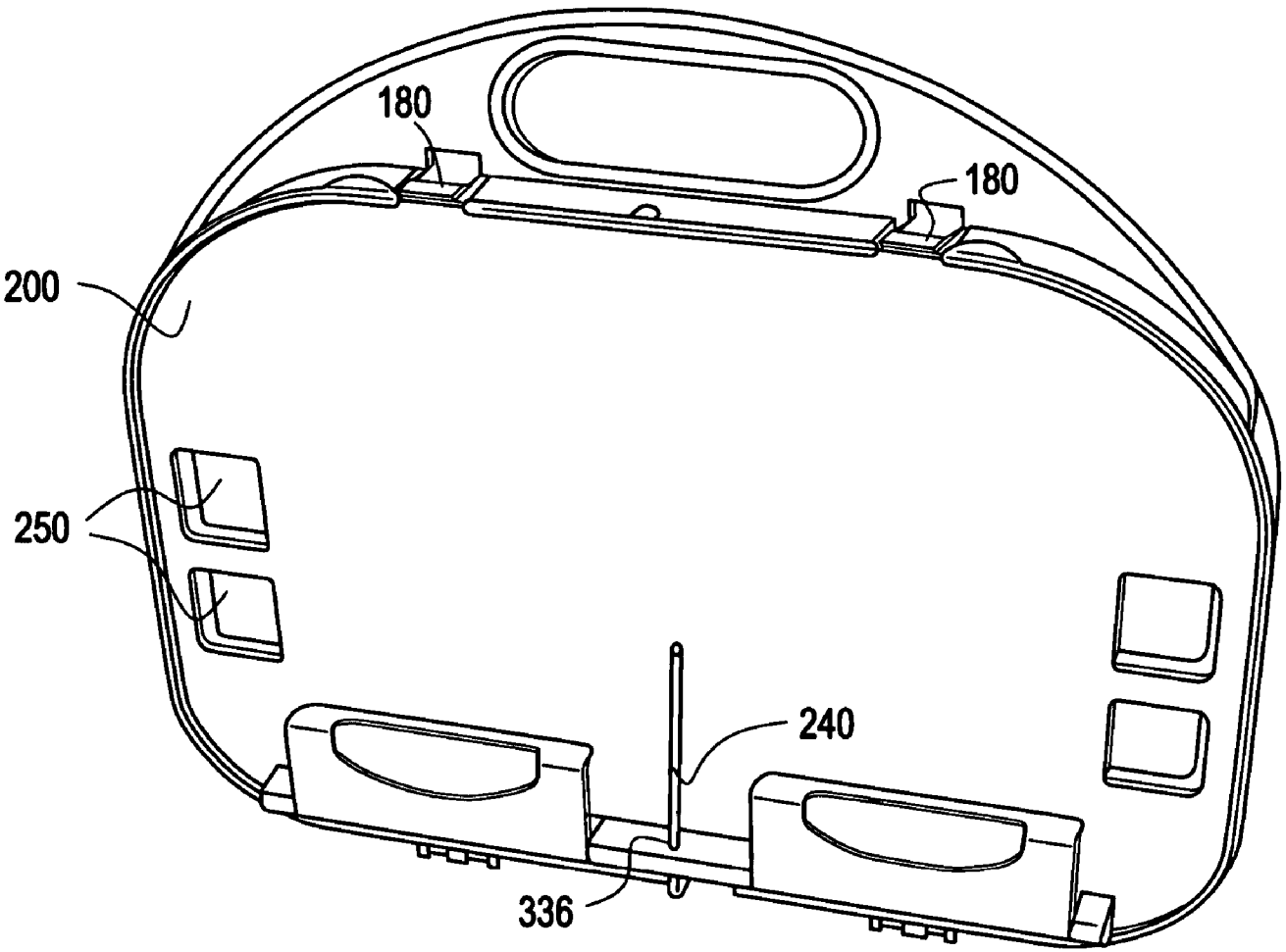
FIG. 5 is a front perspective view of the reading stand of FIG. 1 in a closed and upright position in accordance with one embodiment of the invention.
Figure 8:
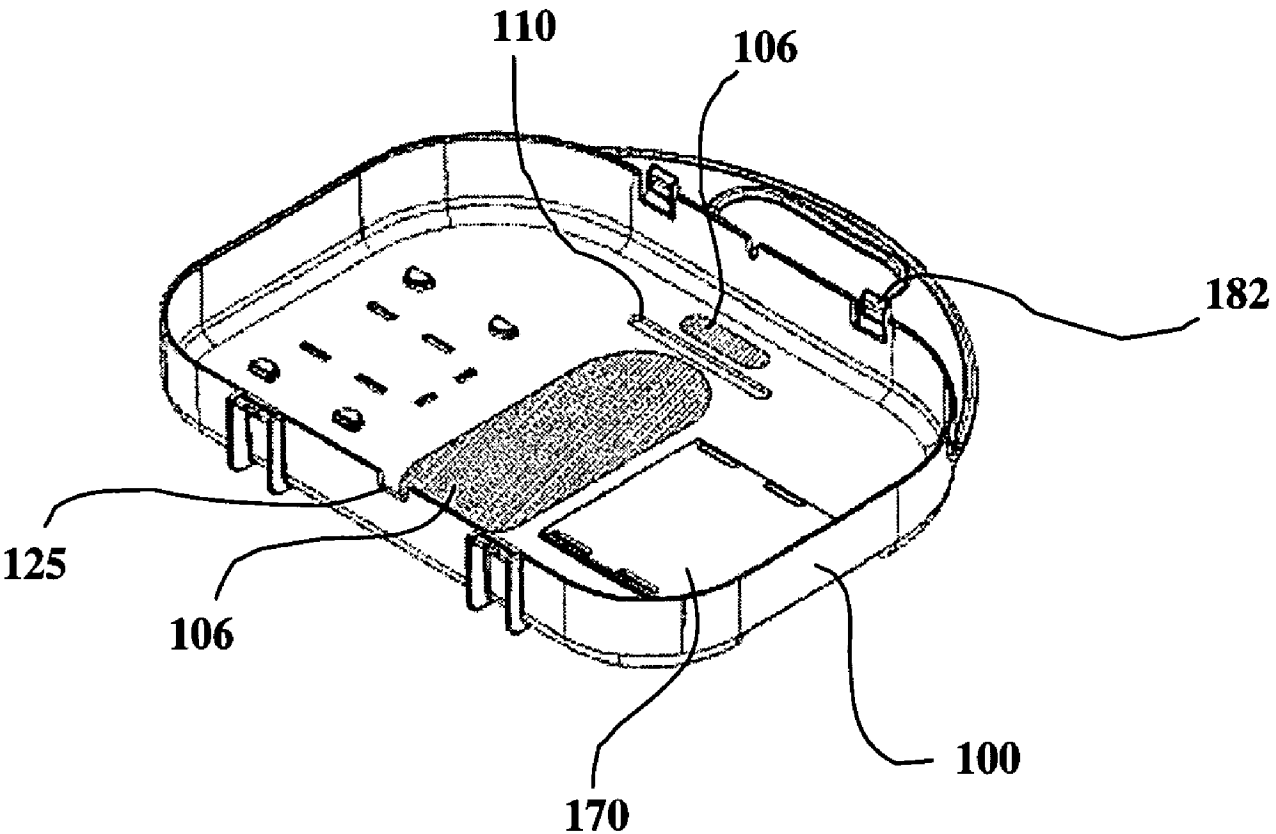
FIG. 8 is a front perspective view of the base member case of a reading stand in accordance with one embodiment of the invention.

As shown in FIGS. 2, 8 and 12, for example, a latch shoulder 284 may be provided in conjunction with a latch arm 182 to collectively provide a latch to secure the reading lid 200 upon the base 100 in a closed position. That is, the latch shoulder 284 is integrally formed with the reading platform 201 and the latch arm 182 is integrally formed with the base member case 101 in accordance with one embodiment of the invention. Accordingly, the latch (182, 284) may used to secure the base member case 101 to the reading platform 201 for carrying or storage of items within the reading stand 10, for example. Relatedly, FIG. 5 is a front perspective view of the reading stand of FIG. 1 in a closed and upright position in accordance with one embodiment of the invention. Further, FIG. 6 is a back perspective view of the reading stand of FIG. 1 in a closed and upright position in accordance with one embodiment of the invention.

In further illustration of the reading stand in accordance with aspects of the invention, FIG. 8 is a front perspective view of the base member case of a reading stand in accordance with one embodiment of the invention, i.e., with the reading lid 200 removed. In accordance with one embodiment of the invention, FIG. 8 shows that the base 100 may be provided with textured areas 106. For example, the textured areas 106 might include a depressed area that will contain embossed narrative and drawings, for example.

Figure 9:
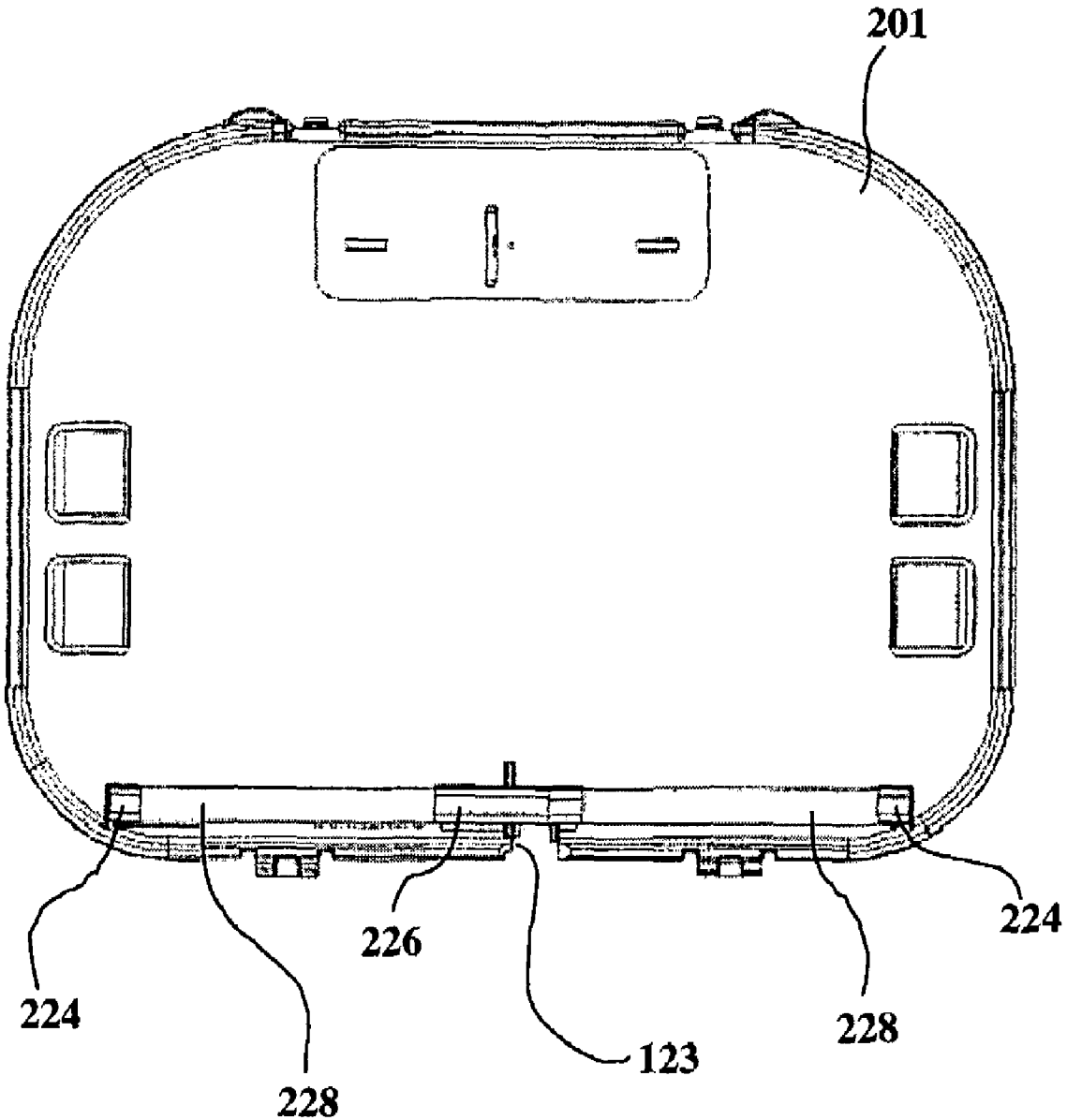
FIG. 9 is a top view of a reading lid of the reading stand for mounting on the base of FIG. 8 in accordance with one embodiment of the invention.

Further, FIG. 9 is a top view of a reading lid of the reading stand for mounting on the base of FIG. 8 in accordance with one embodiment of the invention. Also, FIG. 10 is a perspective view of the reading lid of FIG. 9, and FIG. 11 is a side view of the reading lid of FIG. 9 in accordance with one embodiment of the invention. Further, FIG. 12 is a back perspective view of a reading stand in a closed position with the base of FIG. 8 and the lid of FIG. 9 in accordance with one embodiment of the invention.

Figure 14:
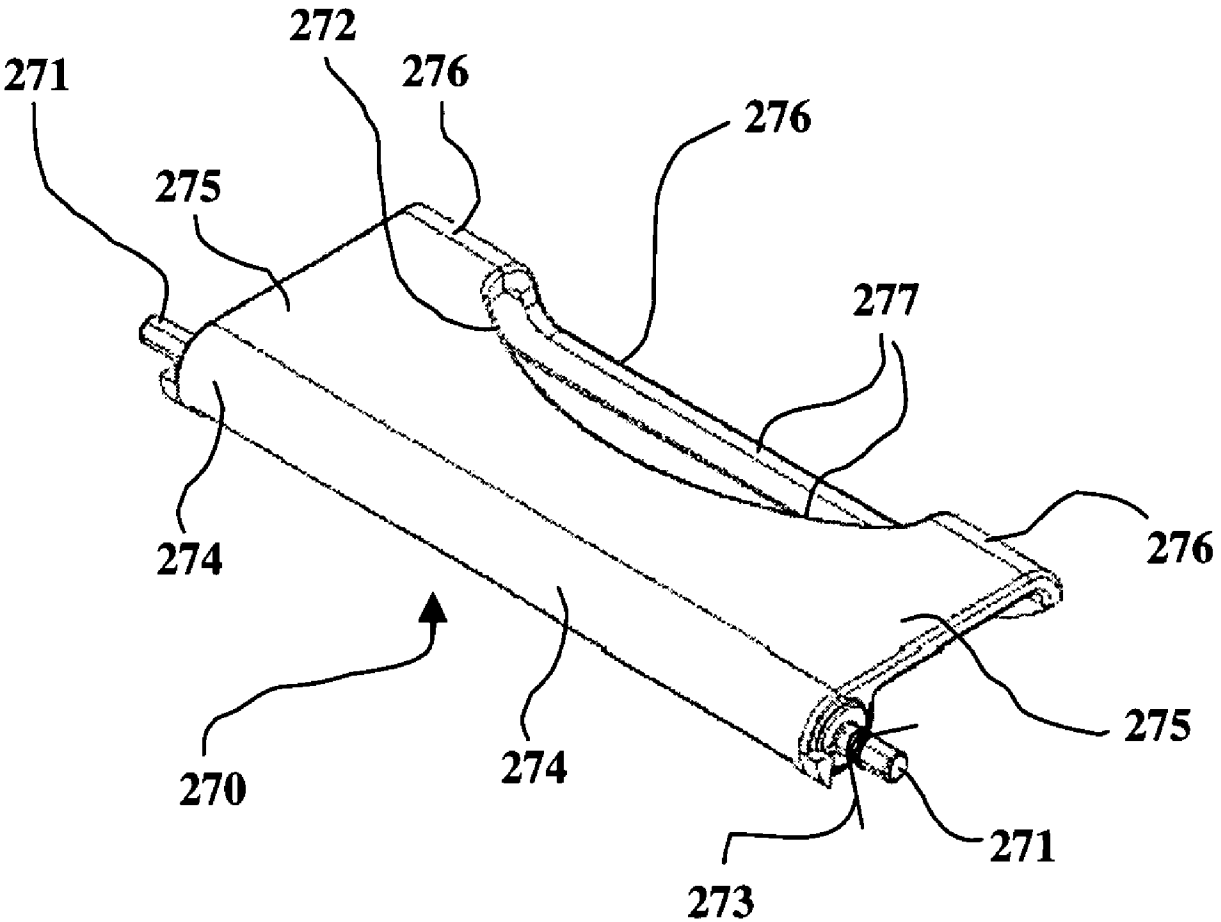
FIG. 14 is a perspective view showing further details of a page holder in accordance with one embodiment of the invention.

FIGS. 9–11 illustrate the manner in which the page holders 270 are mounted on the reading platform 201. The reading lid 200 includes multiple page holder end housings 224 to support respective page holders 270. That is, each page holder end housing 224 works in conjunction with a page holder center housing 226 so as to retain a respective page holder 270. More specifically, as shown in FIGS. 9–11, the page holder end housing 224 provides a page holder channel 225. Further, the page holder center housing 226 provides a channel 227. As shown in FIG. 14, the page holder 270 is provided with a set of page holder pins 271, in accordance with one embodiment of the invention. The page holder pins 271 are respectively disposed in the page holder channel 225 and the channel 227, i.e., so as to pivotally attach the page holder 270 to the reading platform 201. In accordance with one embodiment of the invention, a spring 273 with arms may be mounted upon each page holder pin 271 so as to engage with one of the page holder channel 225 or the channel 227 and bias the page holder 270 against the reading platform 201, i.e., so as to frictionally hold a document, for example. Accordingly, the page holder 270, including the page holder pins 271, is disposed in a slot 228 (see FIG. 9) in the reading platform 201 so as to position the page holder pins 271 within the channels (225, 227).

Relatedly, FIG. 7 shows an opposing side of the channel 227 with the page holder 270 (with pins 271 and spring 273) positioned within the channel 227. As shown in FIG. 7, after the page holder 270 (and specifically the pins 271) are positioned in the channels (225, 227), a stop piece 229 may be disposed so as to secure the pins 271 in place. For example, the stop piece 229 may simply include a small piece of material glued to the channels (225, 227).

The structure of page holder 270 will hereinafter be described in further detail. As shown in FIG. 1, FIG. 10 and FIG. 14, for example, the reading stand 10 includes a reading platform 201 and at least one page holder 270 pivotally disposed upon and connected to the reading platform, the page holder biased against the reading platform for retaining a document. With reference to FIG. 14, the page holder 270, in accordance with one embodiment of the invention, includes a holder housing portion 274 extending along a first side of the page holder 270, a center planar portion 275 extending along the holder housing portion 274, and an arcuate flange 276 extending along the center planar portion 275. An aperture 277 is defined by the arcuate flange and the center planar portion.

As shown in FIG. 14, the holder housing portion 274 is tubular in shape. Further, as shown in FIG. 1, for example, the page holder may be supported on the reading platform on respective sides of the page holder by respective housings (224, 226) formed upon the reading platform, the housings each extending from the reading platform. Also, the holder housing portion 274 of the page holder 270 may be provided so as to form a continuous surface with the housings (224, 226).

With further reference to FIG. 10, the page holder center housing 226 is provided with a center housing slot 336 in accordance with one embodiment of the invention. The center housing slot 336 allows the passage there through of a leg of the center document support 240, i.e., the leg 240' (see FIG. 7) of the center document support 240 that contacts with a book.

Figure 15:
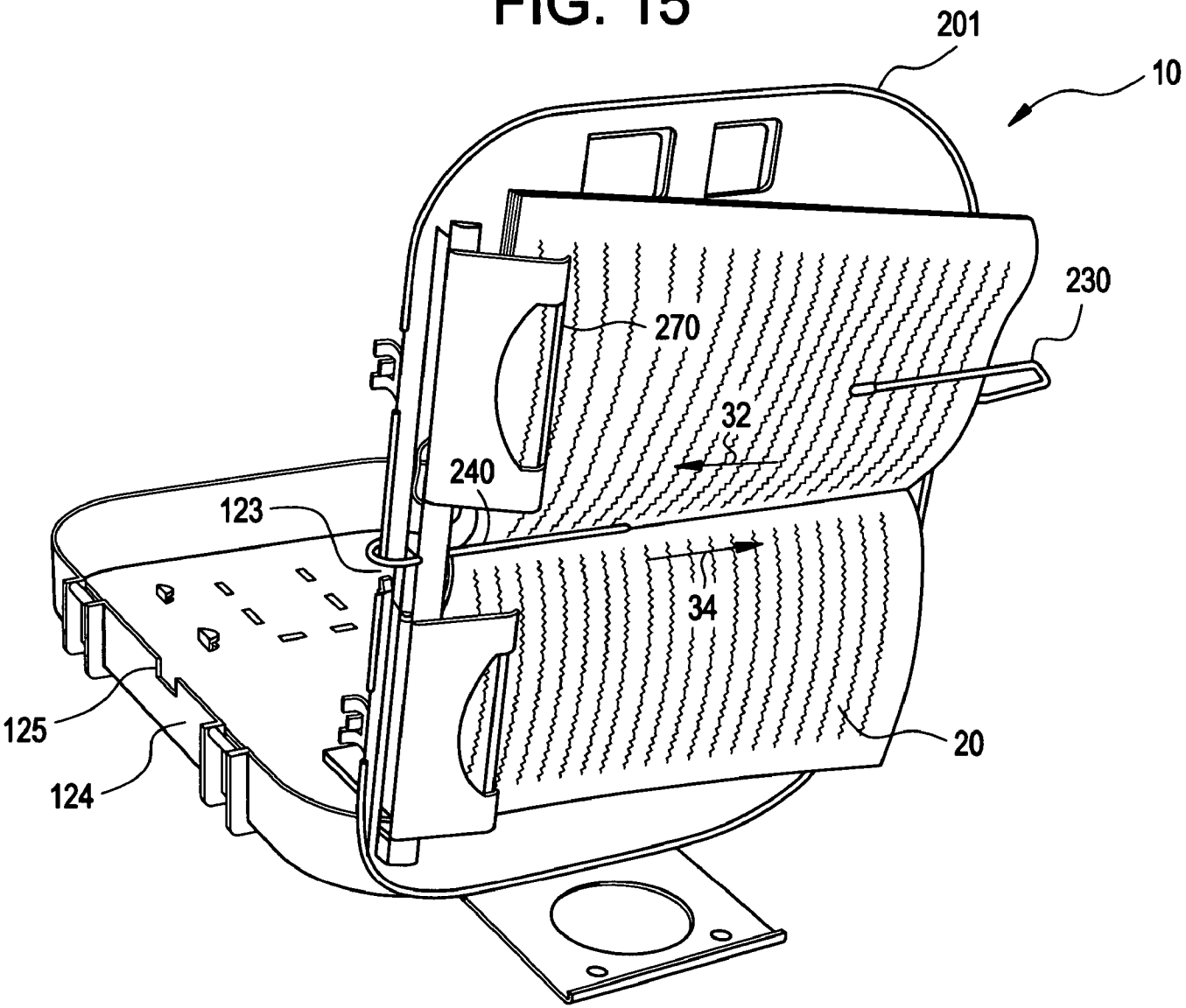
FIG. 15 is a perspective view showing a side reading arrangement in accordance with one embodiment of the invention.
Figure 16:
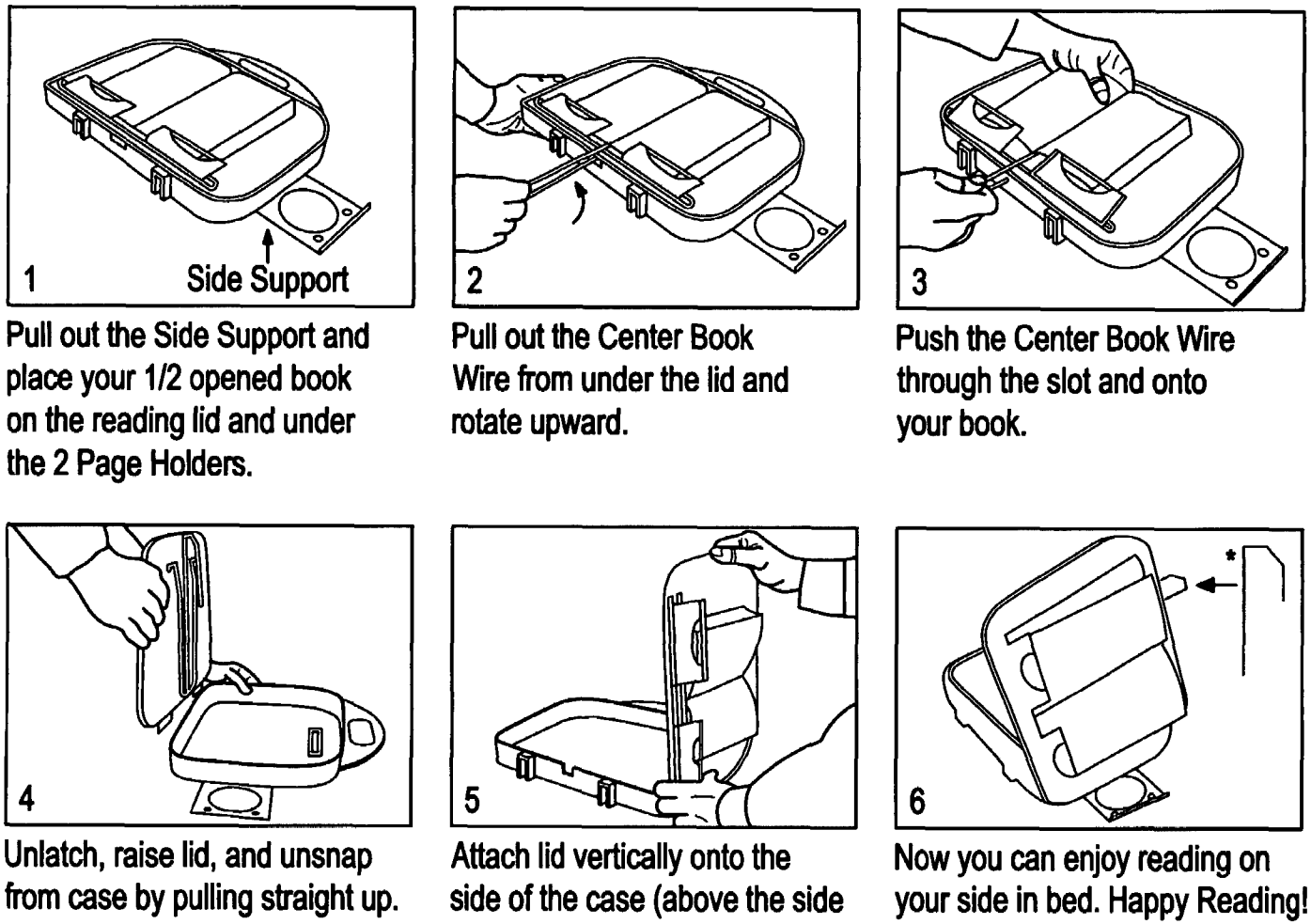
FIG. 16 is a flow chart showing preparation of a reading stand for an on-side bed reading position in accordance with one embodiment of the invention.

In further explanation of the invention, FIG. 15 is a perspective view of a reading stand 10 showing a side reading arrangement in accordance with one embodiment of the invention. Further, FIG. 16 is a flow chart showing the steps so as to arrive at the arrangement as shown in FIG. 15. The arrangement of FIG. 15 allows one to read upon their side while in bed, for example. In particular, the arrangement of FIG. 15 allows side hands-free reading in that a book 20, for example, is fully supported by the reading stand 10. It should of course be appreciated though that manipulation of the book 20 with the reader's hands would be needed to turn pages.

In particular, the book of FIG. 15 is secured upon the reading platform 201 by the various securement devices provided by the reading stand 10. The book 20 is secured using the page holders 270. Further, the center document support 240 is positioned in the center of the book 20. The center document support 240 is positioned within the center of the book 20 by extracting the center document support 240 from the reading platform 201 (as shown by arrow 32) and then sliding the center document support 240 back (as shown by the arrow 34) to the position shown in FIG. 15. This sliding is afforded by the primary collar 242 and the bracing collar 244, as shown in FIG. 4 and FIG. 7, for example.

Further, the reading platform 201 and the base back wall 124 are each provided with respective notches so as to allow the user to manipulate the center document support 240. That is, the base back wall 124 is provided with a notch 125, and the reading platform 201 is provided with a notch 123, as shown in FIG. 15.

The book 20 of FIG. 15 is further retained on the reading platform 201 by the page assist support 230, i.e., the page assist support 230 prevents the upper page of the book 20 from falling. The page assist support 230 is positioned and maintained in the position of FIG. 15 by manipulating the page assist lock 290, as shown in FIG. 4, for example, i.e., so as to lock the page assist support 230 into the position shown in FIG. 15. Also, as described herein, the side reading brace assembly 170 prevents the reading stand 10 from tipping over.

FIG. 16 is a flow chart showing preparation of a reading stand for an on-side bed reading position in accordance with one embodiment of the invention, as noted with reference to FIG. 15 above. As shown in FIG. 16, the process starts in step 1. In step 1, the user pulls out the side support 174 and places an opened book on the reading lid and under the two page holders 270. Then, in step 2, the user pulls out the center document support 240 from under the lid and rotates the center document support 240 upward. Then, the process passes to step 3.

In step 3, the user pushes the center document support 240 through the center housing slot 336, as described above with reference to FIG. 10, and continues to push the center document support 240 onto the book.

Then, in step 4, the user unlatches the latches 180, raises the reading lid 200, and unsnaps the reading lid 200 from the base 100 by pulling straight up. That is, the user disengages the hinge assembly 160 by pulling the hinge shoulder portion 266 (so as to flex the fingers that form the hinge shoulder portion 266) away from the pin 162. In short, the user unsnaps the reading lid 200 from the base 100.

Thereafter, in step 5, the user positions the reading lid 200 so as to attach the reading lid vertically onto the side of the base 100, i.e., using the side support clips 250. As shown in FIG. 16, the reading lid 200 is attached on the side with the side reading brace assembly 170. A page assist support 230 may be used to prevent falling of the pages of the book when positioned sideways. Thereafter, in step 6, the user is left to enjoy reading while laying on the user's side in bed, for example.

Figure 17:
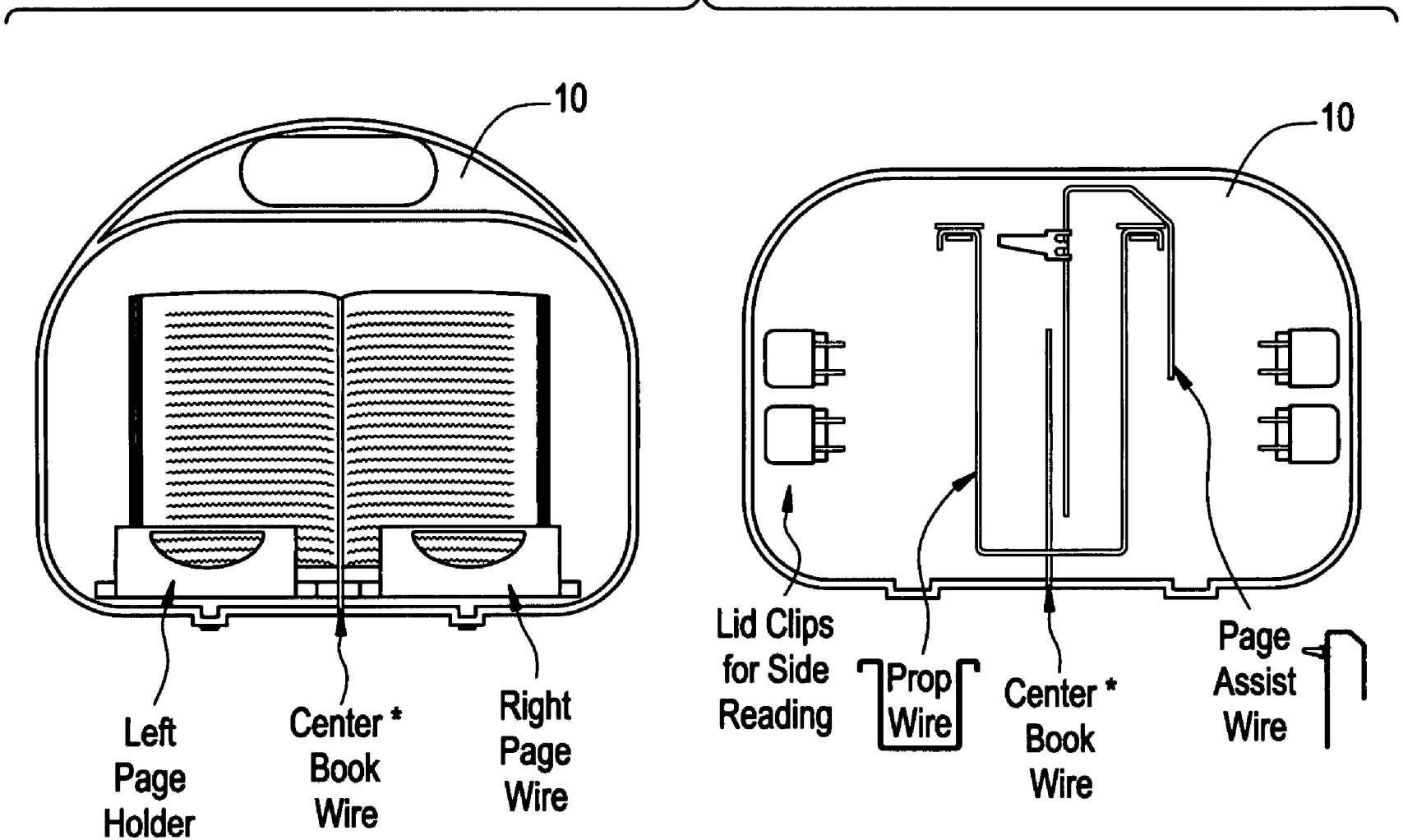
FIG. 17 is a block diagram of a reading stand in accordance with one embodiment of the invention.

FIG. 17 is a block diagram of a reading stand in accordance with one embodiment of the invention. FIG. 17 is provided to show further aspects of a lid of a reading stand 10', in accordance with one embodiment of the invention. It should be appreciated that the lid in accordance with the various embodiments of the invention described herein, might be used independently, i.e., without an associated base. As shown, the reading stand 10' includes a left page holder, as well as a right page holder. Further, the reading stand 10' includes a center book wire, which is provided to retain a book upon the reading stand 10'.

The reading stand 10' also includes lid clips for side reading and a prop wire for propping the lid as shown in FIG. 17. The reading stand 10' of FIG. 17 further includes a center book wire and a page assist wire, as described in detail above. The center book wire and the page assist wire, as referred to in FIG. 17 are typically tucked behind the reading lid and their use is optional. For example, the center book wire and the page assist wire are recommended for on-side reading, heavy books, thick paper backs, and for holding any books that are difficult to keep open, for example. Once the center book wire is inserted in the center of the book, it can remain permanently in the center of the book as the book is read from cover to cover.

In accordance with one aspect of the invention, it is appreciated that in accordance with embodiments of the invention, it is not necessary that a wire be used to retain a document, as described herein, i.e., to serve as the page assist support 230 and/or the center document support 240. Rather, other suitable structure might also be used, such as a plastic structure.

Figure 18:
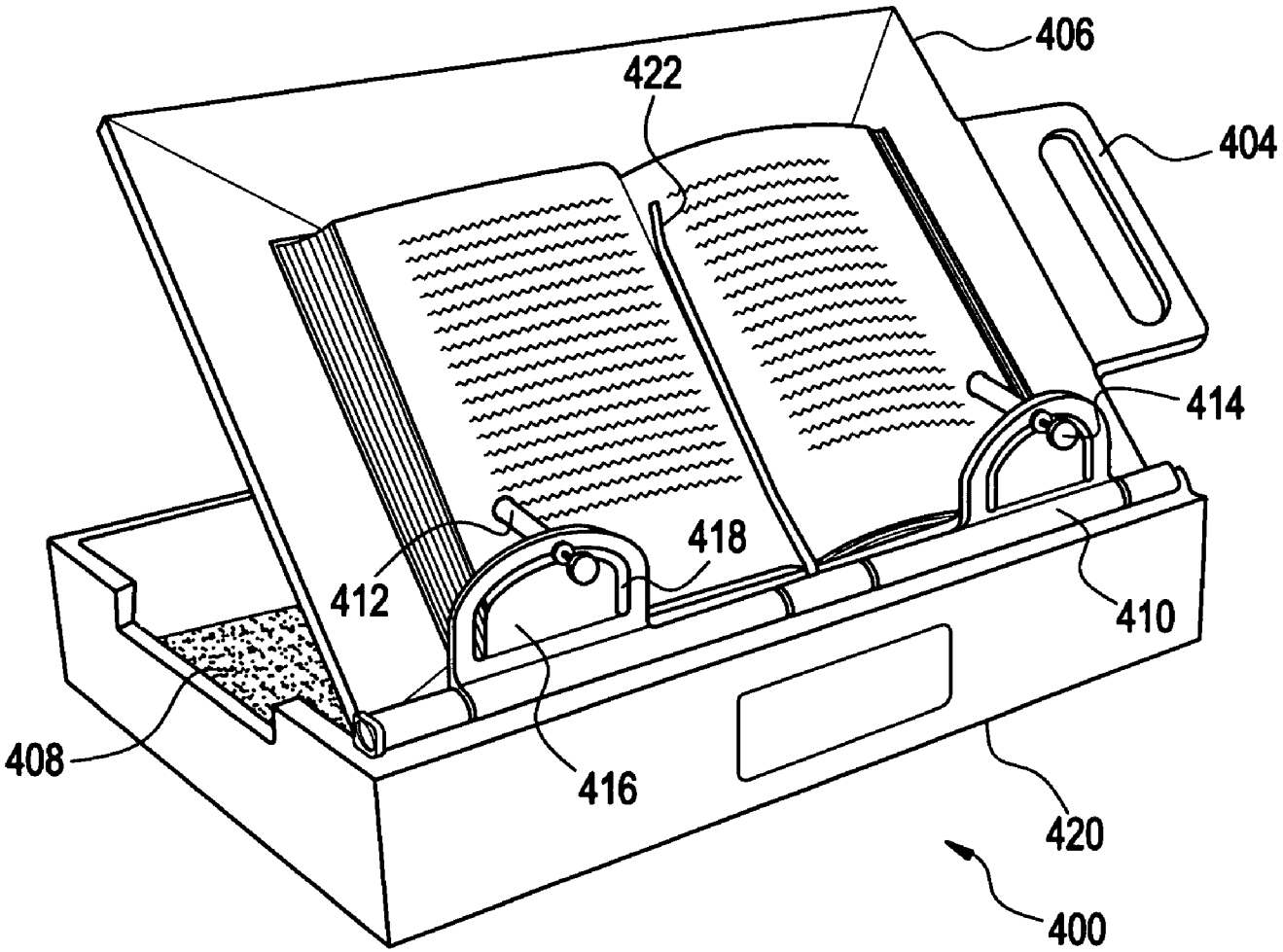
FIG. 18 is a diagram showing a reading stand supporting a book in accordance with a further embodiment of the invention.
Figure 19:
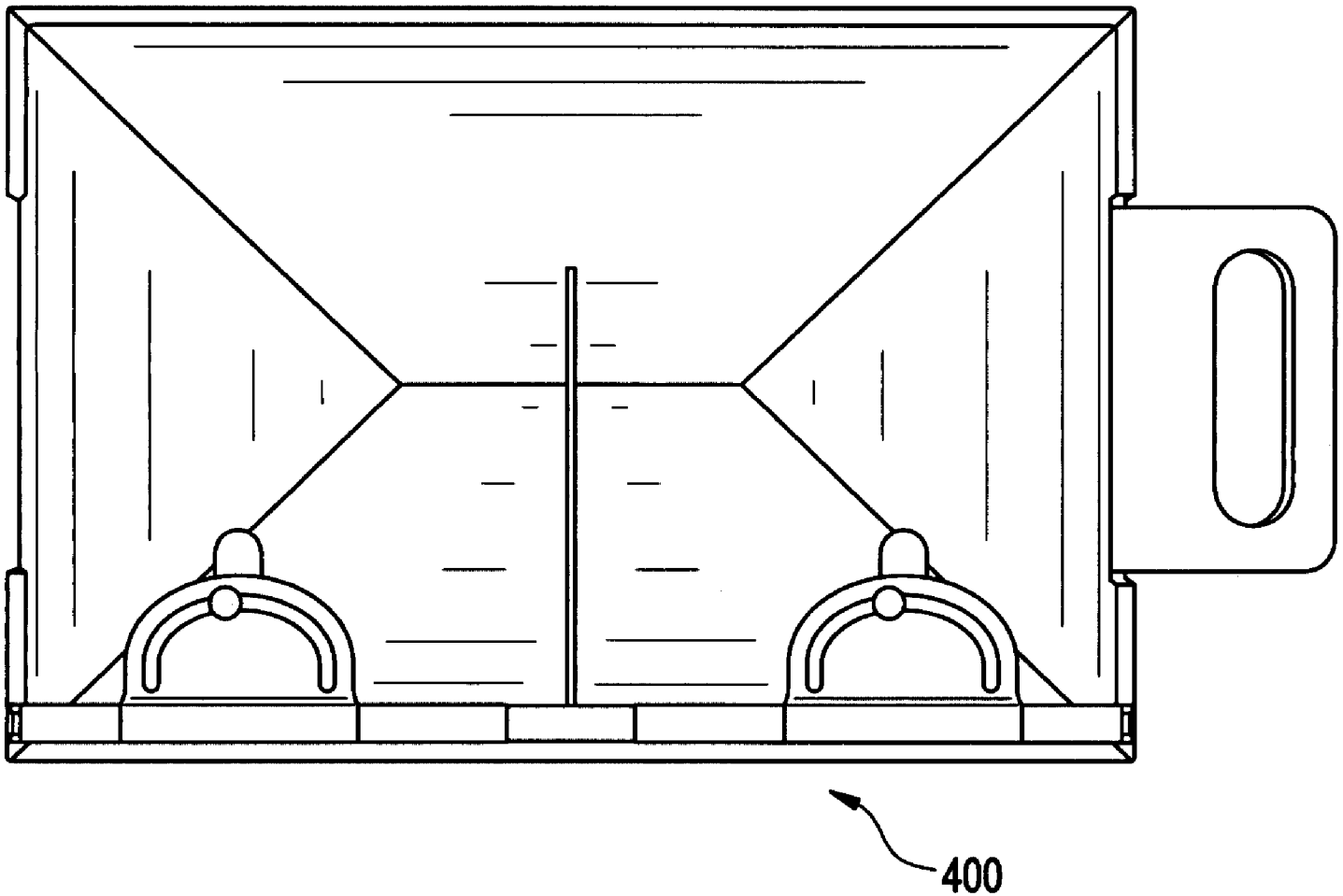
FIG. 19 is the reading stand of FIG. 18 in a different position for supporting a book in accordance with one embodiment of the invention.

FIG. 18 is a diagram showing a reading stand supporting a book in accordance with a further embodiment of the invention. FIG. 19 is the reading stand of FIG. 18 in a different position for supporting a book in accordance with one embodiment of the invention.

FIG. 18 shows a reading stand 400 in accordance with a further embodiment of the invention. As shown in FIG. 18, as well as in FIG. 19, the reading stand 400 includes a supporting portion 406 that is hinged along one side, using hinge 410, to a body portion 420. The body portion 420 may be in the form of a box with the supporting portion 406 forming the top of the box. That is, the body portion 420 might have four sides and a bottom.

Arms or other arrangements are provided to retain pages open on opposing sides of a book, for example. The arms might be in the form of rods 412 that are secured to respective plates 416. The arms might be arranged so as to be connected to the hinge 410. Further, a rod 422 is implemented, in accordance with one embodiment of the invention, to be disposed in the center of the book, for example. The rod 422 may serve to support the book upon the supporting portion 406, along with the plates 416 and the rods 412.

As shown in FIG. 1, the reading stand 400 may have a handle 404 on the right hand side for example. The handle 404 provides a support for a user to hold the reading stand. The handle 404 of course could be positioned on the left side, or alternatively, on both sides. Further, the handle 404 may be fixed and immovable relative to a supporting portion 406 of the reading stand 400, or alternatively, the handle 404 might be movable relative to the supporting portion 406. That is, the handle 404 might slide underneath the supporting portion 406 so as to be retracted in a non-use position. The travel of the handle 404 between an extended use position and a retracted non-use position may be controlled by suitable stops, as should be appreciated.

As shown in FIG. 18, the supporting portion 406 might be supported by a rod (not shown) that rests in the cavity 408 of the reading stand, i.e., the rod might rest in a slot in the back of the supporting portion 406. During non-use, the rod might simply be free in the reading stand. Alternatively, the supporting portion 406 of FIG. 1 might be adjustably supported in a desired position by other techniques, i.e., such as by friction arrangement in hinge 410.

As shown in FIG. 1, rods 412 may be used to retain pages of the book in a desired position. The rod 412 might include a threaded end 414, which may be loosened. The threaded end 414 allows the rod 412 to be loosened and adjusted relative to plate 416. That is, the rod 412 may be repositioned within a groove 418 in the plate 416.

Figure 20:
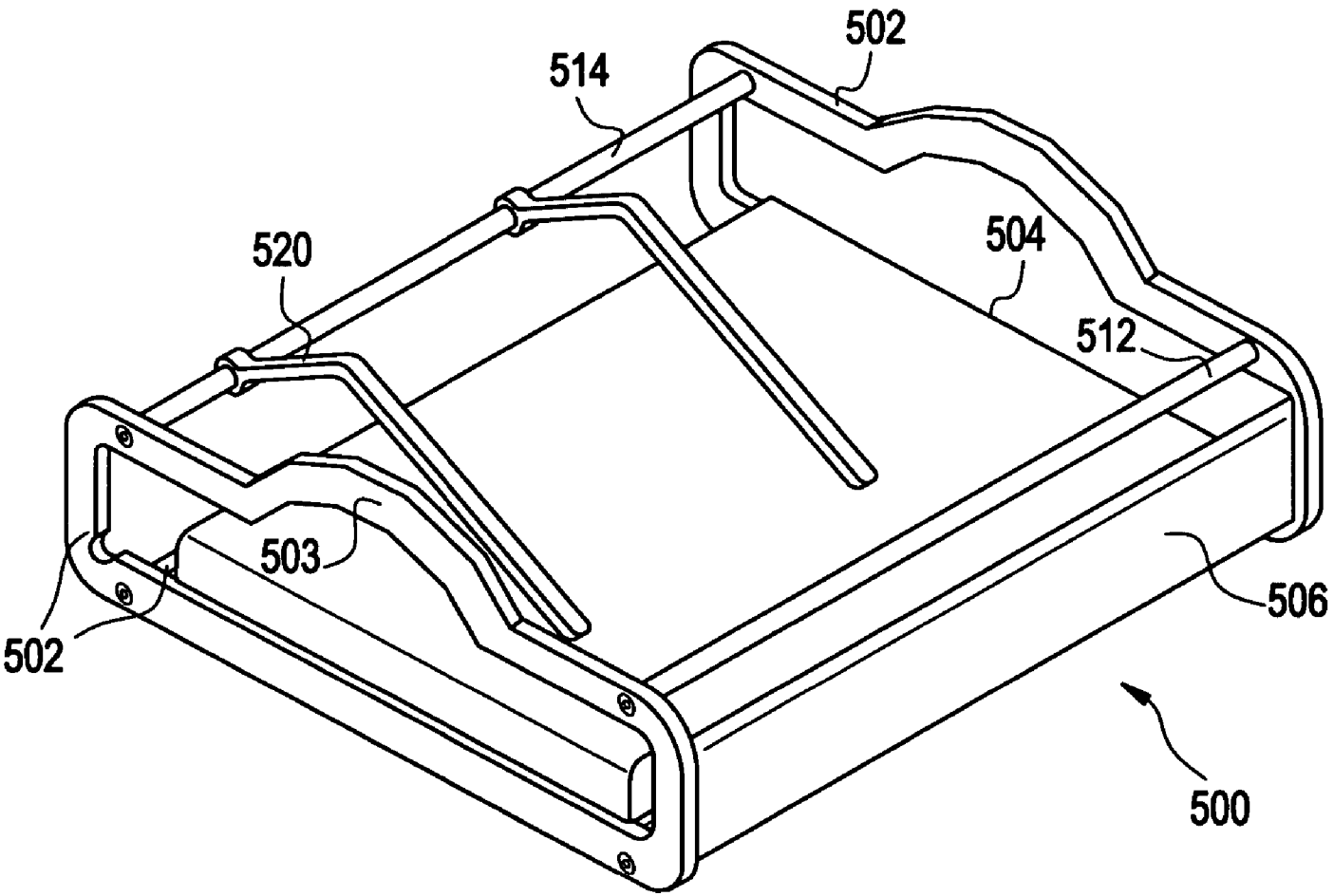
FIG. 20 is a diagram showing a reading stand supporting a book in accordance with a further embodiment of the invention.

FIG. 20 is a diagram showing a reading stand 500 in accordance with a further embodiment of the invention. The reading stand 500 of FIG. 20 includes a frame 502 upon which is supported a base cushion 504. The base cushion 504 is provided to afford a soft surface upon which to rest a book or other document, in accordance with one embodiment of the invention.

The reading stand 500 further includes bars (512, 514) extending between frame portions of the frame 502, as shown in FIG. 20. The frame 502 may be shaped to provide handles 503. Further, the reading stand 500 may be provided with arms 520, which are rotateably mounted on the bar 514. The arms 520 are movably adjustable so as to be disposed upon the page of a book, the example.

As described herein, the devices above, in accordance with the various embodiments of the invention, have been described as a reading stand and described in the context of holding a book. However, it is appreciated that the devices of the invention may be used to hold a wide variety of materials for viewing, as may be desired. Accordingly, the devices of the invention might hold books, magazines, papers, photographs or any other object that might be physically supported on the device. Further, the term "book" as used herein is understood to mean any document with connected pages or portions, for example.

The devices of the invention, in accordance with the various embodiments, may be made from any of a wide variety of materials, as is desired. For example, one embodiment of the invention may be made of aluminum and wood with a foam rubber cushion that accommodate books of varying thickness. The invention might be made of wood, plastic or metal, for example, or any other material. Further, a variety of production techniques may be used to make the reading stand as described herein. For example, suitable molding techniques might be utilized. Also, the various components of the reading stand may be integrally formed, as may be desired, in particular when using molding construction techniques. Also, as shown in FIGS. 1, 18 and 20, for example, the respective arrangements may be adjusted to accommodate books of varying sizes. Further, the respective arrangements may be provided in various sizes, as desired.

In conclusion, it will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A reading stand comprising:

a base including a base member case, the base member case including a base panel and walls connected to the base panel to form an enclosed volume;

a reading lid disposed upon the base member case, the reading lid including:

a reading platform having a front side and a backside;

at least one page holder adjustably mounted on the reading platform so as to assist in retaining a document on the front side of the reading platform; and a support member, the support member extending from the backside of the reading platform, the support member adapted to engage with the base so as to support the reading lid upon the base;

wherein the support member is a prop member, the prop member pivotally connected to the backside of the reading platform, the prop member being engageable with the base member case so as to support the reading platform; and wherein the base panel includes a prop slot, the prop member extendable through the prop slot to extend exterior to the base member case so as to provide a hanger for the reading stand.

2. The reading stand of claim 1, wherein the prop member extendable through the prop slot to extend exterior to the base member case, so as to provide a hanger for the reading stand, provides a hanger for securing the reading stand on a treadmill structure.

3. The reading stand of claim 1, wherein, with the prop member extending through the prop slot to extend exterior to the base member case, the reading lid is disposed upon the base member case in a closed position.

4. The reading stand of claim 1, wherein the prop member is engageable with the base panel of the base member case so as to rest upon and be supported by the base panel.

5. The reading stand of claim 4, wherein the prop member supports the reading platform at an angle of between approximately 20 degrees and 70 degrees relative to the base panel.

6. The reading stand of claim 4, wherein the prop member is a wire structure.

7. The reading stand of claim 4, wherein the prop member is u-shaped.

8. The reading stand of claim 4, wherein the prop member is attached to the reading platform by a hinge assembly.

9. A reading stand comprising:

a base including a base member case, the base member case including a base panel and wails connected to the base panel to form an enclosed volume;

a reading lid disposed upon the base member case, the reading lid including:

a reading platform having a front side and a backside;

at least one page holder adjustably mounted on the reading platform so as to assist in retaining a document on the front side of the reading platform; and a support member, the support member extending from the backside of the reading platform, the support member adapted to engage with the base so as to support the reading lid upon the base;

wherein the support member is a prop member, the prop member pivotally connected to the backside of the reading platform, the prop member being engageable with the base member case so as to support the reading platform;

wherein the prop member is engageable with the base panel of the base member case so as to rest upon and be supported by the base panel; and wherein the base panel includes a prop slot, the prop member extendable through the prop slot to extend exterior to the base member case, in an alternative configuration, so as to provide a hanger for the reading stand.

10. The wading stand of claim 4, wherein the reading lid further includes a center document support and a page assist support.

11. The reading stand of claim 4, wherein the reading lid further includes a center document support, the center document support attached to the backside of the reading platform and positionable in front of the reading platform so as to retain a document in place for reading.

12. The reading stand of claim 11, wherein the center document support is u-shaped.

13. The rending stand of claim 11, wherein the center document support is attached to a backside of the reading platform with a primary collar and a bracing collar.

14. The reading stand of claim 4, wherein the reading lid further includes page assist support, the page assist support attached to a backside of the reading platform and positionable in front of the reading platform so as to retain a document in place for reading.

15. The reading stand of claim 14, wherein the page assist support is attached to the backside of the reading platform with a page assist lock.

16. The reading stand of claim 15, wherein the page assist lock includes a cam collar and a cam lever.

17. The reading stand of claim 16, wherein the page assist support is u-shaped.

18. A reading stand comprising:

a base including a base member case, the base member case including a base panel and walls connected to the base panel to form an enclosed volume;

a reading lid disposed upon the base member case, the reading lid including:

a reading platform having a front side and a backside;

at least one page holder adjustably mounted on the reading platform so as to assist in retaining a document on the front side of the reading platform; and a support member, the support member extending from the backside of the reading platform, the support member adapted to engage with the base so as to support the reading lid upon the base;

wherein the support member is a prop member, the prop member pivotally connected to the backside of the reading platform, the prop member being engageable with the base member case so as to support the reading platform;

wherein the prop member is engageable with the base panel of the base member case so as to rest upon and be supported by the base panel;

wherein the reading lid further includes page assist support, the page assist support attached to a backside of the reading platform and positionable in front of the reading platform so as to retain a document in place for reading;

wherein the page assist support is attached to the backside of the reading platform with a page assist lock;

wherein the page assist lock includes a cam collar and a cam lever;

wherein the page assist support is u-shaped; and wherein the reading lid further includes at least one side support clip disposed upon the reading platform, the side support clip adapted to support the reading platform upon a base side wall of the base member case.

19. The reading stand of claim 18, wherein the reading platform is supportable such that the base side wall of the base is disposed between the side support clip and an aperture wall of the reading platform, the aperture wall being defined by an aperture in the reading platform.

20. The reading stand of claim 1, wherein the reading stand further includes at least one hinge, the at least one hinge pivotally connecting the reading lid to the base.

21. The reading stand of claim 20, wherein the at least one hinge includes a pin integrally connected to the base member case and a hinge shoulder portion integrally formed with the reading platform.

22. A reading stand comprising:

a base including a base member case, the base member case including a base panel and walls connected to the base panel to form an enclosed volume;

a reading lid disposed upon the base member case, the reading lid including:

a reading platform having a front side and as backside;

at least one page holder adjustably mounted on the reading platform so as to assist in retaining a document on the front side of the reading platform; and a support member, the support member extending from the backside of the reading platform, the support member adapted to engage with the base so as to support the reading lid upon the base;

wherein the walls connected to the base panel to form an enclosed volume include a base front wall, a base back wall and two base side walls; and wherein the support member is at least one side support clip disposed upon and extending from a backside of the reading platform, the side support clip adapted to support the reading platform upon one of the base side walls.

23. The reading stand of claim 22, wherein the reading platform is supportable such that the base side wall of the base is disposed between the side support clip and the reading platform.

24. The reading stand of claim 22, further including a side reading brace, the side reading brace being adjustably positionable between;

a stowed position in which the side reading brace is disposed in a tray housing in the base member case; and an extended position in which the side reading brace extends out from the base member case such that the side reading brace prevents the reading stand from tipping.

25. The reading stand of claim 24, wherein the reading lid further includes a page assist support and a center document support for retaining a document upon the reading platform.

26. The reading stand of claim 25 wherein the page assist support and the center document support are each in the form of a wire structure.

27. The reading stand of claim 24, further including a recessed panel in the base panel, the recessed panel forming a cardholder.

28. The reading stand of claim 23, further including a prop member extending from the backside of the reading platform, and wherein the prop member is positionable so as to support the reading platform upon the base member case in an alternative configuration to the reading platform being supported by the side support clip.

29. A reading stand for holding a document for reading comprising:

a base;

a reading lid including a reading platform, a hinge and a side support clip, the reacting lid further including at least one page holder;

the hinge adapted to connect the base to the lid such that the lid is disposed in a closed position over the base; and the side support clip adapted to connect the base to the lid such that the lid is disposed in a substantially vertical position over the base so as to afford side reading.

30. The reading stand of claim 29, further including a center document support slidably connected to the reading platform and positionable within the center of the document disposed upon the reading platform.

31. The reading stand of claim 30, further including a page assist support, the page assist support being positionable to hold pages of the document in position for reading.

32. The reading stand of claim 31, wherein the page assist support is connected to the reading platform by a cam and lever assembly.

33. A method for supporting a document using a reading stand, the reading stand having a lid and a base, the method comprising:

placing an opened book on the lid of the reading stand and under at least one page holder, which is connected to the lid;

pulling out a center document support from under the lid and rotating the center document support upward;

pushing the center document support through a slot and onto the book;

unsnapping the lid from the base; and positioning the lid so as to attach the reading lid substantially vertically onto a side of the base using side support clips mounted on the lid, so as to attach the lid to the base and provide side reading.

34. The method of claim 33, further including pulling out a side support disposed in the base of the reading stand.

35. The method of claim 33, further including positioning a page assist support to retain the book in place.

36. A reading stand having a lid and a base, the reading stand comprising:

means for placing an opened book on the lid of the reading stand and under at least one page holder, which is connected to the lid;

means for pulling out a center document support from under the lid and rotating the center document support upward, and thereafter pushing the center document support through a slot and onto the book;

means for unsnapping the lid from the base; and means for positioning the lid so as to attach the reading lid substantially vertically onto a side of the base using side support clips mounted on the lid, so as to attach the lid to the base and provide side reading.

* * * * *